US012312788B2

(12) United States Patent
McClory

(10) Patent No.: US 12,312,788 B2
(45) Date of Patent: May 27, 2025

(54) REVERSIBLE BAFFLE FOR DISPOSER SYSTEM AND METHOD OF IMPLEMENTING SAME IN A SINK FLANGE OF A DISPOSER SYSTEM

(71) Applicant: Emerson Electric Co., St. Louis, MO (US)

(72) Inventor: Kevin McClory, Racine, WI (US)

(73) Assignee: INSINKERATOR LLC, Benton Harbor, MI (US)

( * ) Notice: Subject to any disclaimer, the term of this patent is extended or adjusted under 35 U.S.C. 154(b) by 1072 days.

(21) Appl. No.: 17/058,030

(22) PCT Filed: Jun. 13, 2019

(86) PCT No.: PCT/US2019/036950
§ 371 (c)(1),
(2) Date: Nov. 23, 2020

(87) PCT Pub. No.: WO2019/241506
PCT Pub. Date: Dec. 19, 2019

(65) Prior Publication Data

US 2021/0164208 A1 Jun. 3, 2021

Related U.S. Application Data

(60) Provisional application No. 62/685,422, filed on Jun. 15, 2018, provisional application No. 62/685,537, filed on Jun. 15, 2018.

(51) Int. Cl.
*E03C 1/266* (2006.01)

(52) U.S. Cl.
CPC ..... *E03C 1/2665* (2013.01)

(58) Field of Classification Search
CPC ..... E03C 1/2665; E03C 1/266; E03C 1/298; B02C 18/0084; B02C 18/0092; B02C 23/36; B02C 2201/06; B02C 2201/063
(Continued)

(56) References Cited

U.S. PATENT DOCUMENTS 2,785,864 A 3/1957 Jordan
2,787,423 A 4/1957 Moore
(Continued)

FOREIGN PATENT DOCUMENTS

CN 101198751 6/2008
CN 101722089 6/2010
(Continued)

OTHER PUBLICATIONS

Communication Pursuant to Rules 161(1) and 162 EPC from the European Patent Office for Patent Application No. 19734209.0 dated Dec. 23, 2020 (3 pages).
(Continued)

*Primary Examiner* — Jimmy T Nguyen
*Assistant Examiner* — Teresa A Guthrie
(74) *Attorney, Agent, or Firm* — Amundsen Davis, LLC

(57) ABSTRACT

Baffles for disposer systems, as well as disposer systems employing such baffles and methods of implementing and operating such baffles and disposer systems. In at least one example embodiment, a baffle includes a cylindrical rim and a plurality of pleats that are attached to, or integrally formed with, the cylindrical rim. A first face of the baffle includes a first structural characteristic and a second face includes a second structural characteristic. The first and second structural characteristics are of a same type but also are different, whereby due at least in part to the first and second structural characteristics being different from one another, the baffle is capable of being implemented within the disposer system in either of first and second orientations, respectively, so that the disposer system is configured to operate to achieve either of first and second functional objectives, respectively.

20 Claims, 9 Drawing Sheets

(58) Field of Classification Search
USPC ..... 241/46.016
See application file for complete search history.

(56) References Cited

U.S. PATENT DOCUMENTS

| | | | |
|---|---|---|---|
| 2,834,554 | A | 5/1958 | Bebinger |
| 2,875,958 | A | 3/1959 | Wieczorek |
| 2,940,677 | A | 6/1960 | Jordan |
| 2,980,351 | A | 4/1961 | Greene |
| 3,432,108 | A | 3/1969 | Enright |
| 3,524,596 | A | 8/1970 | Smith |
| 6,719,228 | B2 | 4/2004 | Breger et al. |
| 6,735,791 | B1 | 5/2004 | Lordahl et al. |
| 7,021,574 | B2 | 4/2006 | Breger et al. |
| D539,078 | S | 3/2007 | Anderson et al. |
| D539,087 | S | 3/2007 | Anderson et al. |
| 7,264,188 | B2 | 9/2007 | Anderson et al. |
| D581,723 | S | 12/2008 | Pan |
| D799,888 | S | 10/2017 | McClory et al. |
| D799,889 | S | 10/2017 | McClory et al. |
| D799,890 | S | 10/2017 | McClory et al. |
| 2002/0104908 | A1 | 8/2002 | Berger et al. |
| 2004/0195409 | A1 | 10/2004 | Berger et al. |
| 2006/0278743 | A1 | 12/2006 | Anderson et al. |
| 2013/0327860 | A1 | 12/2013 | Harooni |
| 2015/0367724 | A1 | 12/2015 | Kopiec et al. |
| 2016/0040413 | A1 | 2/2016 | Starkey et al. |
| 2016/0076234 | A1 | 3/2016 | Hammer et al. |
| 2018/0361391 | A1 | 12/2018 | Starkey et al. |
| 2020/0347584 | A1 | 11/2020 | Berger et al. |

FOREIGN PATENT DOCUMENTS

| | | |
|---|---|---|
| CN | 203939099 | 11/2014 |
| CN | 204875981 | 12/2015 |
| CN | 105220742 | 1/2016 |
| CN | 205329795 | 6/2016 |
| CN | 106284555 | 1/2017 |
| CN | 106687648 | 5/2017 |
| CN | 206768951 | 12/2017 |
| DE | 959244 | 2/1957 |
| GB | 1120289 | 7/1968 |
| JP | 2005500148 | 1/2005 |
| WO | WO 02062478 | 8/2002 |

OTHER PUBLICATIONS

Response to European Office Action for Patent Application No. 19734209.0 dated Jul. 1, 2021 (11 pages).

First Office Action from the State Intellectual Property Office of China for Application No. 2019800399277 dated Sep. 15, 2021 (21 pages).

Response to the First Office Action from the State Intellectual Property Office of China for Patent Application No. 2019800399277 dated Jan. 28, 2022 (33 pages with English Translations of Amended Claims).

Response to European Office Action for Patent Application No. 19704167.6 dated Feb. 15, 2021 (7 pages).

Anaheim Manufacturing, "Food Waste Disposer Owner's Guide," guide, Doc No. 560C485P01 Rev A, believed to be publicly available as early as Jun. 2006, pp. 1-8.

Anaheim Manufacturing, "3 images showing Removable Baffle," images, available from Anaheim Manufacturing Company, believed to be publicly available as early as Jun. 2006, p. 1.

General Electric Company, "Food Waste Disposer Installation/Use & Care Instructions," instruction guide, Part No. 165D4700P179 Rev 1, Pub No. 49-5853, believed to be publicly available from General Electric as early as Jan. 1998, pp. 1-7.

General Electric Company, "3 images showing Removable Baffle," images, available from General Electric, believed to be publicly available prior to 2002, p. 1.

General Electric Company, "Disposall Food Waste Disposer, Owner's Manual & Installation Instructions," instruction guide, 49-55075, believed to be publicly available from General Electric as early as Aug. 19, 2010, pp. 1-12.

General Electric Company, "3 images showing Removable Baffle," images, believed to be publicly available from General Electric as early as 2011, p. 1.

Emerson Electric Company, "Food Waste Disposer, Mounting Gasket Kit," packaging image, MGK-OO (77047 Rev. B), believed to be publicly available from In-Sink-Erator division of Emerson Electric, prior to 2013, p. 1.

Viking Range Corporation, "3 images showing Removable Baffle," images, available from Viking Range Corporation, believed to be publicly available as early as 2004, p. 1.

Emerson Electric Company, "Food Waste Disposers Model No. 777ss," specs, Form No. H538-04F-02, believed to be publicly available from In-Sink-Erator division of Emerson Electric Co. prior to 2009, p. 1.

Emerson Electric Company, "Household Disposer (UL) Model No. 777SS-1," parts list, Engineer No. 71947, Emerson Electric Co., dated Feb. 16, 1998, p. 1.

Emerson Electric Company, "Badger Disposal Installation Instructions" instruction guide (78649 Rev. B), In-Sink-Erator Division of Emerson Electric Co. (2018) p. 1-2.

Emerson Electric Company, "Food Waste Disposer, Standard Mounting Gasket," packaging image, SMG-OO (77027 Rev. B), believed to be publicly available from In-Sink-Erator division of Emerson Electric Co. prior to 2013, p. 1.

Viking Range Corporation, "Installation Instructions for Heavy-Duty Food Waste Disposer," instruction guide, F1208B (PS0103VR) believed to be publicly available by 2004, pp. 1-4.

Viking Range Corporation, "Heavy-Duty Food Waste Disposer, Use & Care Manual," manual, believed to be publicly available by 2004, pp. 1-7.

Emerson Electric Company, "Evolution Excel Installation Instructions," instruction guide (74167 Rev. A), In-Sink-Erator division of Emerson Electric Co., believed to be publicly available by Oct. 8, 2007, p. 1.

Emerson Electric Company, "Evolution Excel Installation Instructions," instruction guide (78220 Rev. A), In-Sink-Erator division of Emerson Electric Co., believed to be publicly available by Feb. 4, 2016, p. 1.

Emerson Electric Company, "Badger Installation Instructions," instruction guide (76711 Rev. B), available from In-Sink-Erator, believed to be publicly available prior to 2014, pp. 1-14.

Emerson Electric Company, "Removable Baffle," image (Part No. 70966), available from In-Sink-Erator, believed to be publicly available by 1994.

Emerson Electric Company, "Evolution Antimicrobial Quiet Collar Sink Baffle for Evolution Garbage Disposals," website, available from In-Sink-Erator division of Emerson Electric Co., believed to be publicly available by 2011 (obtained at https://www.homedepot.com/p/InSinkErator-Evolution-Antimicrobial-Quiet-Collar-Sink-Baffle-for-Evolution-Garbage-Disposals-QCB-AM/100466658), pp. 1-3.

Emerson Electric Company, "Antimicrobial Quiet Collar Sink Baffle (Evolution Series)" website (74653D) believed to be publicly available prior to 2013, pp. 1-10; https://insinkerator.emerson.com/en-us/shop/insinkerator/insinkerator-quietclrbaf.

Whirlpool, "Top 19 Best Food Waste Disposer Parts/List Appliances," brochure, Aug. 18, 2017, pp. 1-5, http://www.listappliances.com/top-19-best-food-waste-disposer-parts[Jul. 29, 2019 2:53:17 PM].

Emerson, "InSinkErator QCB-AM Anti-Microbial Quiet Collar Sink Baffle, 3.25-Inch Diameter . . . ," website, believed to be publicly available at least as early as 1999, pp. 1-9, https://www.amazon.com/dp/B000GX34AE/ref=psdc_3226849011_tl_B01M0FVWTQ.

Emerson Electric Company, "1 image showing Removeable Baffle." image, available from In-Sink-Erator division of Emerson Electric Co., believed to be publicly available by 2011.

(56) References Cited

OTHER PUBLICATIONS

PCT/US2019/036949 International Search Report and Written Opinion of the International Searching Authority dated Oct. 24, 2019 (18 pages).
PCT/US2019/036949 International Preliminary Report on Patentability dated Dec. 15, 2020 (1 page).
PCT/US2019/014806 International Search Report and Written Opinion of the International Searching Authority dated May 9, 2019 (11 pages).
PCT/US2019/014806 International Preliminary Report on Patentability dated Jul. 28, 2020 (1 page).
PCT/US2019/036950 International Search Report and Written Opinion of the International Searching Authority dated Oct. 24, 2019 (18pages).
PCT/US2019/036950 International Preliminary Report on Patentability dated Dec. 15, 2020 (1 page).
First Office Action from the State Intellectual Property Office of China for Application No. 201980018730.5 dated Mar. 26, 2021 (10 pages).
Communication Pursuant to Rules 161(1) and 162 EPC from the European Patent Office for Patent Application No. 19704167.6 dated Aug. 5, 2020 (3 pages).
Response to European Office Action for Patent Application No. 19704167.6 dated Feb. 15, 2021 (3 pages).
Office Action from the US Patent and Trademark Office for U.S. Appl. No. 16/963,012 dated May 12, 2022 (11 pages).
Notification on Grant of the Patent from the State Intellectual Property Office of China for Application No. 201980039927.7 dated Jun. 1, 2022 (5 pages).
Communication Pursuant to Rule 94(3) from the European Patent Office for Patent Application No. 19704167.6 dated Jun. 15, 2022 (1 pages).
Communication Pursuant to Rule 71(3) from the European Patent Office for Patent Application No. 19734209.0 dated Jul. 25, 2022 (7 pages).
Response to Office Action from the US Patent and Trademark Office for U.S. Appl. No. 16/963,012 dated Aug. 10, 2022 (12 pages).

REVERSIBLE BAFFLE FOR DISPOSER SYSTEM AND METHOD OF IMPLEMENTING SAME IN A SINK FLANGE OF A DISPOSER SYSTEM

FIELD

The present disclosure relates to waste disposers such as food waste disposers and, more particularly, to baffles or splash guard components or features of such waste disposers, as well as methods of implementing and operating same.

BACKGROUND

In conventional food waste disposers, there is typically a baffle or splash guard across the throat opening. For example, in some food waste disposers, the throat baffle is inserted into the sink opening (strainer flange) and is removable by the user from the sink side. Also for example, in some other food waste disposers, the baffle is integrated with the mounting gasket and is only removable when the entire disposer is dismounted from the sink Removable baffles often can be installed relative to strainer flanges of disposers and held in place relative to those strainer flanges by the interplay of annular grooves formed in the baffles and complementary annular ribs of the strainer flanges. When the baffles are press fit into the strainer flanges, the annular ribs fit into the annular grooves, such that the baffles are retained relative to the strainer flanges.

Depending upon the embodiment, the baffle of a food waste disposer can serve any of a variety of different purposes. For example, in at least some conventional embodiments, during disposer operation the baffle prevents splash back or particle ejection during grinding. Also for example, the baffle in many or most (if not all) conventional embodiments constitutes the primary user interface with the disposer, as the food waste must pass through the baffle, usually assisted by the operator, to enter the grind chamber. Further for example, the baffle, also in at least some conventional embodiments, prevents foreign objects such as silverware or sponges from entering the disposer both during operation and when not in use.

In at least some conventional embodiments, the baffle is made of an elastomer such as nitrile rubber and has a pleated configuration. The pleats allow the baffle opening to enlarge as food waste is pushed through. The baffle however is also an obstacle to food waste entering the grind chamber. More particularly, in at least some disposers, the pleats of the baffle are stiff enough to hold a layer of water over the baffle opening (or openings) during the operation of the disposer, while permitting an adequate flow of water for grinding. Such a design results in water coverage over the openings during operation, which attenuates the noise from the grind chamber, because the baffle (throat) opening is typically the dominant path for the transmission of noise from the grind chamber to the user. One example of a baffle that is used to reduce the noise transmission via the baffle opening path is described in U.S. Pat. No. 7,264,188, which issued on Sep. 4, 2007 and is entitled "Noise baffle for food waste disposer," the contents of which are hereby incorporated by reference herein.

Notwithstanding the effectiveness of certain conventional baffles in reducing noise during grinding, at least some such conventional baffles can have undesirable side effects. For example, the presence of the baffles in sinks can result in the backing up of water into the sinks. In some cases, when water flows through a baffle into the grind chamber of a disposer, air inside the grind chamber is displaced and is vented up out of the grind chamber back through the baffle. Although there can be vent features or openings in the baffle that are intended to facilitate the venting out of the displaced air from the disposer, in some circumstances the flowing water obstructs the vent openings before the displaced air has been vented, which prevents or restricts the air from leaving the grind chamber. Consequently, an air bubble can develop under the baffle, and the air bubble that is formed under the baffle prevents the water from draining through the baffle and causes water to back up into the strainer flange and into the sink Such operation can appear to indicate a clogged sink problem to a user, and cause concern for the user. Further, even though a user can readily remedy such operation by pushing down on the baffle pleats and displacing the trapped air (which can be colloquially referred to as "burping the baffle"), the user can find taking such action to be inconvenient or distasteful.

Also for example, the presence of a conventional baffle can make it undesirably difficult to get food waste into the grinding chamber of a disposer. In some cases, to achieve the desired passing of food into the grinding chamber, users will push food through the baffle with either their hands or various utensils or devices. However, users again can find taking such actions to be inconvenient or distasteful. Additionally, although other conventional baffles have pleats that may quickly sag or droop when the baffles are in use, so as to create larger center openings and diminish the resistance posed by the baffles to food waste entering the disposers, food disposers employing such baffles can be viewed by some users as operating in a manner that is overly-aggressive in terms of the extent to which the disposers draw food into the grinding chambers of the disposers. Additionally, the presence of sagging baffles in some embodiments can also increase the probability of foreign objects entering the disposer.

Indeed, in some conventional baffles it is not desired that the pleats of the baffles sag (or not desired that the pleats sag beyond a particular degree), but nevertheless one or more of the pleats of the baffles tend to sag excessively or become misaligned (e.g., relative to others of the pleats) over time due to ongoing usage of the disposers with which the baffles are associated. This can particularly occur because, over time, the resilience of the elastomer, rubber or other materials from which the baffles and the pleats thereof are formed can become diminished, such that the pleats tend not to return to (or tend not to return fully to) their normally-closed positions when not burdened with the flow of water and other materials through the baffle or when the disposers are not operating. It will be appreciated that, when the pleats of a baffle sag or droop, the baffle's ability to prevent water and food waste from splashing out of the disposer grind chamber during use is diminished.

In view of the above, it can be recognized that it is often desired that a given throat baffle of a given disposer satisfy a variety of different functional objectives, all when implemented in conjunction with that given disposer. Indeed, it is often desired that two or more, or all, of the following objectives be met by a single baffle, at least when operated at different times or under different circumstances (if not simultaneously or substantially simultaneously), when implemented in conjunction with a given disposer: the baffle should have pleats that do not sag or at least do not excessively sag; the baffle should operate to prevent or at least significantly inhibit material from exiting the grind chamber by way of the baffle; the baffle should also allow appropriate material (e.g., food waste) to easily enter the grind chamber; the baffle should further make it more difficult for inappropriate material to enter the grind chamber; the baffle should attenuate noise (e.g., noise from the grind chamber as the disposer is run); and the baffles should permit adequate water flow, or in some cases facilitate high water flow, for grinding and promoting the flow of material out of the disposer.

Notwithstanding the above, satisfying several or all of the aforementioned various functional objectives by way of a single baffle when implemented in conjunction with a given disposer can be challenging, particularly insofar as several of these functional objectives tend to be in conflict with one another to a significant degree. For example, as already discussed, although some conventional baffles are capable of providing significant noise attenuation, such conventional baffles can suffer from one or more side effects resulting from design features that are provided to achieve such noise attenuation. Thus, with respect to at least some conventional sound reducing baffles, users will complain that the baffles make it too difficult for food to pass into the grinding chambers (e.g., food cannot pass through the baffles as freely as may be desired), and yet be pleased with the reduced noise levels associated with the disposers during grinding operation.

Put in another manner, with respect to at least some conventional baffles, the baffles are not able to both achieve the water barrier on top of the pleats of the baffle when the baffle is experiencing low water flow rates and also avoid backing up of water when the baffle is experiencing high water flow rates (e.g., as can be provided from high water flow faucets). Indeed, many conventional baffles can handle high water flow rates without backing up, but cannot pool water to block sound from the disposer, and other conventional baffles that operate well as sound deadening baffles tend to create a water barrier and have better sound performance, but have a tendency to back up with high water flow rates.

Additionally, not only can it be difficult to satisfy a variety of functional objectives substantially simultaneously in general, but also the difficulty of doing so through the use of a particular baffle design can be exacerbated by the fact that there exist numerous different possible installation set ups, arrangements, and environments with respect to which the baffle can be implemented. For example, different plumbing arrangements (e.g., different kitchen faucets having a wide range of flow rates) or water temperatures that are experienced during the operation of different disposers and associated baffles can impact the ability of water to flow through a baffle such that a given baffle will achieve desired water flow when implemented in connection with one plumbing arrangement or when the flowing water is at a first temperature, but will not achieve the same desired water flow when implemented in connection with a different plumbing arrangement or when the flowing water is at a second temperature.

Thus, conventional baffles often are particularly suitable for use in connection with particular installation set ups, arrangements, or environments, within which those baffles can allow one or more particular functional objectives to be achieved, rather than other installation set ups, arrangements, or environments. Conversely, particular installation set ups, arrangements, or environments may be particularly suited to receive particular conventional baffle designs, but not others, given the particular functional objectives that the particular baffle designs can achieve when implemented in those installation set ups, arrangements, or environments. Correspondingly, to achieve different functional objectives at different times in connection with a particular installation set up, arrangement, or environment, it may be necessary to replace one baffle with a different baffle. Because the characteristics of conventional baffle designs are typically suited for achieving one or more particular functional objectives (but not other(s)) when implemented in connection with particular installation set ups, arrangements, or environments, users may be undesirably restricted in terms of the approaches that are available for addressing various concerns in various disposer implementation contexts.

Additionally, notwithstanding the above discussion concerning the difficulties associated with achieving multiple different functional objectives via baffles, it should further be appreciated that certain functional objectives remain difficult to achieve by way of conventional baffles even when other functional objectives are not of significant concern. For example, the undesirable sagging of pleats that occurs in conventional baffles with rubber pleats, as those baffles are operated over long periods of time, often remains a concern regardless of whether other functional objectives, such as those described above, are being achieved by those baffles. That is, the avoidance of pleat sagging remains a single functional objective that is of significant concern with respect to conventional baffles, independent of other functional objectives.

Accordingly, it would be desirable if one or more improved baffles or disposer systems employing baffles, or improved methods of baffle or disposer system implementation or operation, could be developed that overcame one or more of the above-described limitations associated with conventional baffles or disposer systems, or that achieved one or more other objectives relating to baffles or disposer systems employing baffles.

BRIEF SUMMARY

In at least some example embodiments encompassed herein, the present disclosure relates to a baffle for a disposer system. The baffle includes a cylindrical rim that extends circumferentially about a central axis, and a plurality of pleats that are attached to, or integrally formed with, the cylindrical rim and that extend radially inwardly toward the central axis. Each of the pleats has a respective radially-innermost edge and the radially-innermost edges of the pleats collectively define, at least partly, a central orifice of the baffle through which the central axis passes and, additionally, the pleats include first pleat portions, second pleat portions, and sidewall portions. Further, each of the first pleat portions is connected by way of a respective pair of the sidewall portions with a respective pair of the second pleat portions, and each of the second pleat portions is connected by way of a respective pair of the sidewall portions with a respective pair of the first pleat portions. Also, each of the first pleat portions, alone or in combination with the respective pair of the sidewall portions between which the respective first pleat portion is positioned, has a first structural characteristic. Further, each of the second pleat portions, alone or in combination with the respective pair of the sidewall portions between which the respective second pleat portion is positioned, has a second structural characteristic. Additionally, the first and second structural characteristics both are of a same type but also are different from one another, whereby due at least in part to the first and second structural characteristics being different from one another, the baffle is capable of being implemented within the disposer system in either of first and second orientations, respectively, so that the disposer system is configured to operate to achieve either of first and second functional objectives, respectively.

Further, in at least some additional example embodiments encompassed herein, the present disclosure relates to a baffle for a disposer system. The baffle includes a cylindrical rim that extends circumferentially about a central axis, and a plurality of pleats that are attached to, or integrally formed with, the cylindrical rim and that extend radially inwardly toward the central axis. Each of the pleats has a respective radially-innermost edge and the radially-innermost edges of the pleats collectively define, at least partly, a central orifice of the baffle through which the central axis passes, and the pleats include first pleat portions and second pleat portions. Additionally, a first face of the baffle is formed at least in part by way of first surface portions of the first pleat portions, second surface portions of the second pleat portions, and a first annular edge of the cylindrical rim, and a second face of the baffle is formed at least in part by way of third surface portions of the first pleat portions, fourth surface portions of the second pleat portions, and a second annular edge of the cylindrical rim. Further, the first face and second face are substantially oppositely directed relative to one another, on opposite sides of a mid-plane of the baffle that extends perpendicularly or substantially perpendicularly relative to the central axis. Also, the first face includes a first structural characteristic and the second face includes a second structural characteristic, and the first and second structural characteristics are of a same type but also are different, whereby due at least in part to the first and second structural characteristics being different from one another, the baffle is capable of being implemented within the disposer system in either of first and second orientations, respectively, so that the disposer system is configured to operate to achieve either of first and second functional objectives, respectively.

Additionally, in at least some further example embodiments encompassed herein, the present disclosure relates to a disposer system. The disposer system includes a disposer and a mounting assembly coupled to the disposer, where the mounting assembly includes a sink flange and a baffle supported within the sink flange. The baffle includes a cylindrical rim extending about a central axis and a plurality of pleats having first pleat portions and second pleat portions extending radially inwardly from locations at or near the cylindrical rim toward the central axis, and also includes a mid-plane extending perpendicularly to the central axis. Further, the baffle is positioned in a first orientation relative to the sink flange but is configured so that the baffle can be repositioned within the sink flange in a second orientation that is inverted relative to the first orientation. Additionally, the pleats include a first structural characteristic that enables the disposer system to operate in accordance with a first operational mode when the baffle is positioned in the first orientation, and also include a second structural characteristic that would enable the disposer system to be configured to operate in accordance with a second operational mode if the baffle was positioned in the second orientation, where the first and second structural characteristics both are of a same type but also are different from one another. Further, the first structural characteristic is selected from the group consisting of a first angular extent of the first pleat portions of the pleats, a first width of first openings proximate first tips of the first pleat portions, a first axial extent of the first tips of the first pleat portions relative to the a mid-plane of the baffle, a first outer diameter of the first pleat portions, a first radial distance between the central axis and the first tips of the first pleat portions, and a first presence or absence off first flow holes extending through the first pleat portions. Additionally, the second structural characteristic is selected from the group consisting of a second angular extent of the second pleat portions of the pleats, a second width of second openings proximate second tips of the second pleat portions, a second axial extent of the second tips of the second pleat portions relative to the a mid-plane of the baffle, a second outer diameter of the second pleat portions, a second radial distance between the central axis and the second tips of the second pleat portions, and a second presence or absence of second flow holes extending through the second pleat portions.

Also, in at least some example embodiments encompassed herein, the present disclosure relates to a baffle for a disposer system. The baffle includes a cylindrical rim that extends circumferentially about a central axis, where a mid-plane of the baffle that is perpendicular or substantially perpendicular to the central axis passes through the cylindrical rim. The baffle additionally includes a plurality of pleats that are attached to, or integrally formed with, the cylindrical rim and that extend radially inwardly toward the central axis, where the pleats have radially-inwardmost edges that collectively define, at least partly, a central orifice of the baffle through which the central axis passes. Also, the baffle including the pleats thereof is configured so as to be implementable relative to and capable of operating within the disposer system in each of a first orientation and a second orientation that is substantially inverted relative to the first orientation.

Further, in at least some example embodiments encompassed herein, the present disclosure relates to a disposer system. The disposer system includes a disposer, and a mounting assembly coupled to the disposer, where the mounting assembly includes a sink flange and a baffle supported within the sink flange. The baffle includes a cylindrical rim that extends circumferentially about a central axis of the baffle, where a mid-plane of the baffle perpendicular to the central axis passes through the cylindrical rim. Also, the baffle includes a plurality of pleats that are attached to, or integrally formed with, the cylindrical rim and that extend radially inwardly toward the central axis, where radially-inwardmost edges of the pleats collectively define, at least partly, a central orifice of the baffle through which the central axis passes. Additionally, the pleats include first pleat portions, second pleat portions, and sidewall portions, where the first pleat portions are substantially positioned on a first side of the mid-plane and the second pleat portions are substantially positioned on a second side of the mid-plane opposite to the first side. Further, the baffle including the pleats thereof is positioned within the sink flange in a first orientation but also is configured so as to be reinstallable within the sink flange in a second orientation that is substantially inverted relative to the first position so as to achieve a functional objective.

Additionally, in at least some example embodiments encompassed herein, the present disclosure relates to a method of operating a disposer system including a sink flange and a baffle having a plurality of pleats. The method includes determining that at least one of the pleats, or at least one portion of the pleats, is experiencing sagging or is likely to experience sagging in the near future, when the baffle has a first orientation within the sink flange. The method also includes removing the baffle from the sink flange, and inserting the baffle into the sink flange of the disposer system so that the baffle has a second orientation that is substantially inverted relative to the first orientation. The inserting of the baffle so that the baffle has the second orientation substantially or entirely alleviates or avoids, for at least a first time period, the sagging.

BRIEF DESCRIPTION OF THE DRAWINGS

Embodiments of food waste disposer throat baffles and related methods are disclosed with reference to the accompanying drawings and are for illustrative purposes only. The food waste disposer throat baffle apparatuses and methods encompassed herein are not limited in their applications to the details of construction, arrangements of components, or other aspects or features illustrated in the drawings, but rather such apparatuses and methods encompassed herein include other embodiments or are capable of being practiced or carried out in other various ways. Like reference numerals are used to indicate like components. In the drawings.

DETAILED DESCRIPTION

Figure 1:
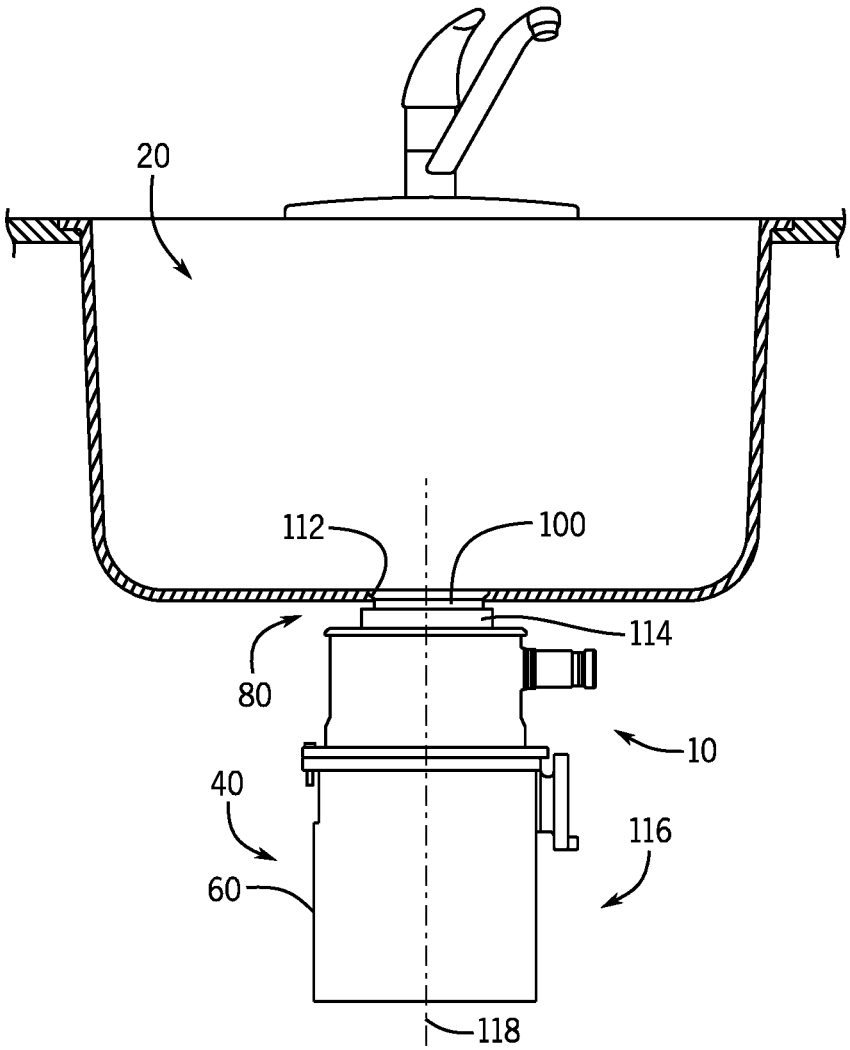
FIG. 1 is a partly cross-sectional, partly front elevation view of an example improved food waste disposer system mounted in relation to a sink (shown in cutaway), where the system includes an improved, reversible baffle and is configured for operation in accordance with a first sound reducing mode due to the reversible baffle having a first orientation.

Referring to FIG. 1, a partly cross-sectional, partly front elevation view of an example improved food waste disposer system 10, in accordance with an example embodiment encompassed herein, is shown to be installed or mounted in relation to a sink 20 (which is also shown in cutaway). FIG. 1 particularly provides a cross-sectional view of the sink 20, so as to better illustrate how the improved food waste disposer system 10 is installed relative to the sink. The improved food waste disposer system 10 includes a disposer assembly 40 that includes a food waste disposer 60 and an improved mounting assembly (or sink flange assembly) 80 that allows for the disposer assembly 40 to be attached to the sink 20. The improved mounting assembly 80 particularly includes an improved reversible baffle 100, a sink flange (or strainer flange) 112, and an upper mounting flange 114. All of the portions of the improved food waste disposer system 10, excepting the reversible baffle 100, can be referred to as a baffle-less food waste disposer system 116.

The sink flange 112 is the portion of the improved food waste disposer system 10 that particularly is attached to the sink 20, and the upper mounting flange 114 enables the disposer assembly 40 to be coupled to the sink flange 112. It should be appreciated that (notwithstanding the general description provided above) FIG. 1 not only provides a cutaway cross-sectional view of the sink 20 but also provides a cross-sectional view of the sink flange 112 of the improved food waste disposer system 10, which is taken along the same vertical plane as is used to determine the cross-sectional view of the sink 20. Illustration of the sink flange 112 in this manner allows the reversible baffle 100 positioned within the sink flange to be revealed. As will be described in further detail below, the reversible baffle 100 is reversible in that it is configured so as to be capable of being implemented within the sink flange in either of two orientations.

In general, the reversible baffle 100 has a circular perimeter and is positioned so as to extend around a central axis 118. Although the central axis 118 can be considered to be the central axis of the reversible baffle, in the embodiment of FIG. 1, it should also be appreciated that the central axis 118 is also the central axis of the sink flange 112 into which the baffle is positioned. Also, consistent with a typical arrangement in which a disposer assembly of a food waste disposer system is positioned vertically beneath a sink, the central axis 118 is shown in FIG. 1 to extend vertically or substantially vertically from the sink 20 downward through the improved mounting assembly 80, including the sink flange 112 and reversible baffle 100 thereof, into a grinding chamber within the food waste disposer 60 of the disposer assembly 40. Thus, in the present embodiment, the central axis 118 can also be considered a vertical axis for the improved food waste disposer system 10 and the sink 20. The reversible baffle 100 in the present embodiment is made from nitrile rubber although, in other embodiments, the reversible baffle can be made from one or more other materials instead of or in addition to nitrile rubber. Such materials can include other elastomers such as thermoplastic elastomers (TPE).

Figure 2:
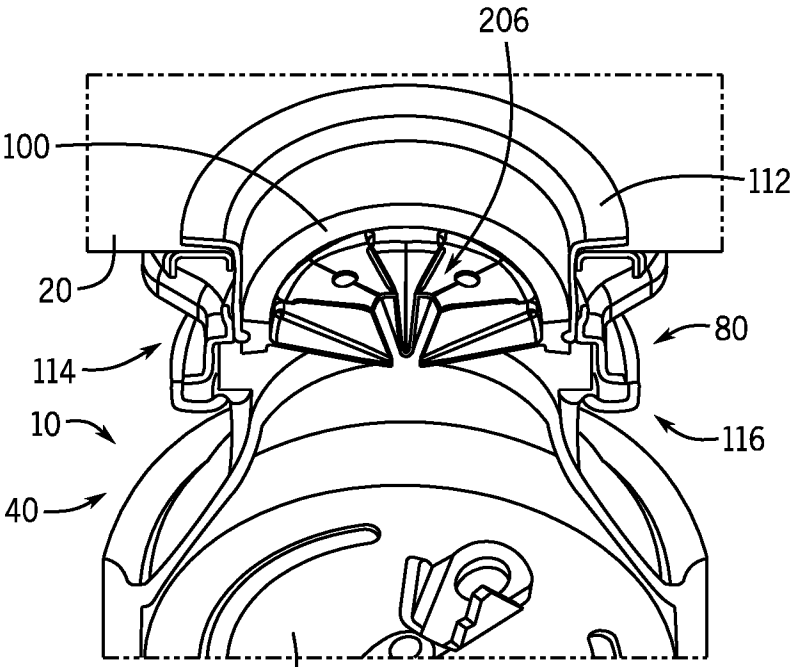
FIG. 2 is an additional perspective, cutaway cross-sectional view of portions of the example improved food waste disposer system and the sink shown in FIG. 1, revealing (among other things) a perspective cross-sectional view of the reversible baffle.

Referring additionally to FIG. 2, an additional, perspective, cutaway cross-sectional view of the improved food waste disposer system 10 of FIG. 1 is provided. Although the cross-section of the improved food waste disposer system 10 of FIG. 2 is taken along the same vertical plane as is used to determine the cross-sectional view of FIG. 1, in FIG. 2 the reversible baffle 100 as well as other portions of the food waste disposer system 10 are also shown in cross-section (rather than merely the sink 20 and sink flange 112). Consequently, among other things, various features of the reversible baffle 100 (described further below) as well as an interior cavity or grinding chamber 200 of the disposer assembly 40 of FIG. 1 are evident from FIG. 2. In particular, a first face 206 of the reversible baffle 100 is shown. As illustrated, the first face 206 in this embodiment faces (or substantially faces) vertically upward, with it being appreciated that, in typical installations of food waste disposer systems relative to sinks such as that shown in FIG. 1 and FIG. 2, the disposer assembly is positioned vertically beneath the sink.

Figure 3:
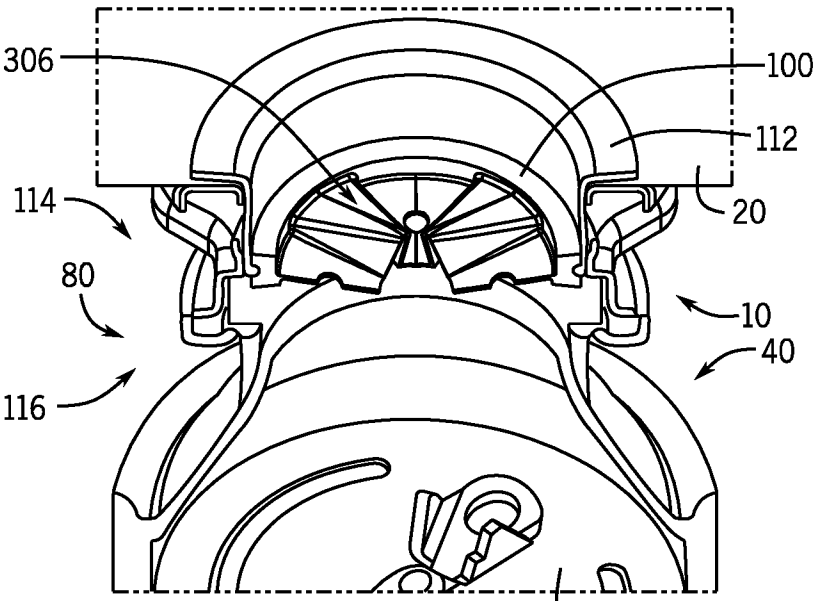
FIG. 3 is a further perspective, cutaway cross-sectional view of the improved food waste disposer system and sink shown in FIG. 2, where the improved food waste disposer system is configured for operation in accordance with a second high water flow mode due to the reversible baffle having a second orientation that is inverted relative to that shown in FIG. 2.

Referring additionally to FIG. 3, in the present embodiment, the reversible baffle 100 is configured so that it can be implemented in relation to the sink flange 112 (and otherwise implemented in relation to the baffle-less food waste disposer system 116) in either of two positions or orientations. As already noted above, FIG. 2 shows an arrangement in which the reversible baffle 100 is oriented in a first position, in which the first face 206 faces vertically (or substantially vertically) upward. By contrast, FIG. 3 shows an arrangement in which the reversible baffle 100 is oriented in a second position in which a second face 306 of the reversible baffle faces vertically (or substantially vertically) upward, with it being appreciated that the first face 206 and the second face 306 are generally opposed (oppositely-directly) faces on opposite sides of the reversible baffle. Thus, in the present embodiment, the reversible baffle 100 is a reversible baffle in that the baffle can be implemented in relation to the sink flange 112 and other associated components of the baffle-less food waste disposer system 116 in each of two alternative positions or orientations that differ from one another by a 180 degree rotation of the baffle about an axis perpendicular to the central axis 118 (as shown in FIG. 1) of the baffle.

In the present embodiment of FIG. 1, FIG. 2, and FIG. 3, the reversible baffle 100 particularly takes the form of an asymmetrical reversible baffle, with the baffle being asymmetrical particularly in terms of differences between the first face 206 and the second face 306 of the baffle. By virtue of this asymmetry, notwithstanding that the reversible baffle 100 is implemented in relation to the same baffle-less food waste disposer system 116 irrespective of the orientation of the reversible baffle, the overall improved food waste disposer system 10, (including the reversible baffle) can experience substantially different behavior and/or achieve different functional objectives depending upon the orientation of the reversible baffle. More particularly, for reasons described in more detail below, during operation of the improved food waste disposer system 10 with the reversible baffle 100 implemented as shown in FIG. 2, a layer of water collects atop the first face 206 such that the disposer system operates in a sound reducing mode. By contrast, also for reasons described in more detail below, the improved food waste disposer system 10 employing the reversible baffle 100 implemented as shown in FIG. 3 tends to avoid operation in which a significant layer of water collects atop any face of the baffle, but rather tends to achieve high water flow operation.

Given this to be the case, it should be appreciated that the improved food waste disposer system 10 is a configurable food waste disposer system that can be configured to operate in two different modes of operation depending upon the orientation of the reversible baffle 100. The improved food waste disposer system 10 is configured for operation in accordance with a first sound reducing mode of operation when the reversible baffle 100 is oriented so that the first face 206 faces vertically or substantially vertically upward, and is configured for operation in accordance with a second, high water flow mode of operation when the reversible baffle is oriented so that the second face 306 faces vertically or substantially vertically upward.

It should be appreciated that, although FIG. 1, FIG. 2, and FIG. 3 show the combination of the baffle-less food waste disposer system 116 with the reversible baffle 100 as constituting the same improved food waste disposer system 10 regardless of whether the disposer system is configured for operation in the sound reducing mode of operation or is configured for operation in the high water flow mode of operation, this need not be understood to be the case. To the contrary, one can consider the improved food waste disposer system 10 when configured for operation in the sound reducing mode as constituting a first improved food waste disposer system, and consider the improved food waste disposer system 10 when configured for operation in the high water flow mode as constituting a second improved food waste disposer system that is different and distinct from the first improved waste disposer system. Nevertheless, for simplicity of reference herein, any combination of the baffle-less food waste disposer system 116 with the reversible baffle 100, regardless of the orientation of the reversible baffle within the sink flange 112, is considered to constitute the same improved food waste disposer system 10, configured for operation in either of the two above-discussed modes.

Figure 4:
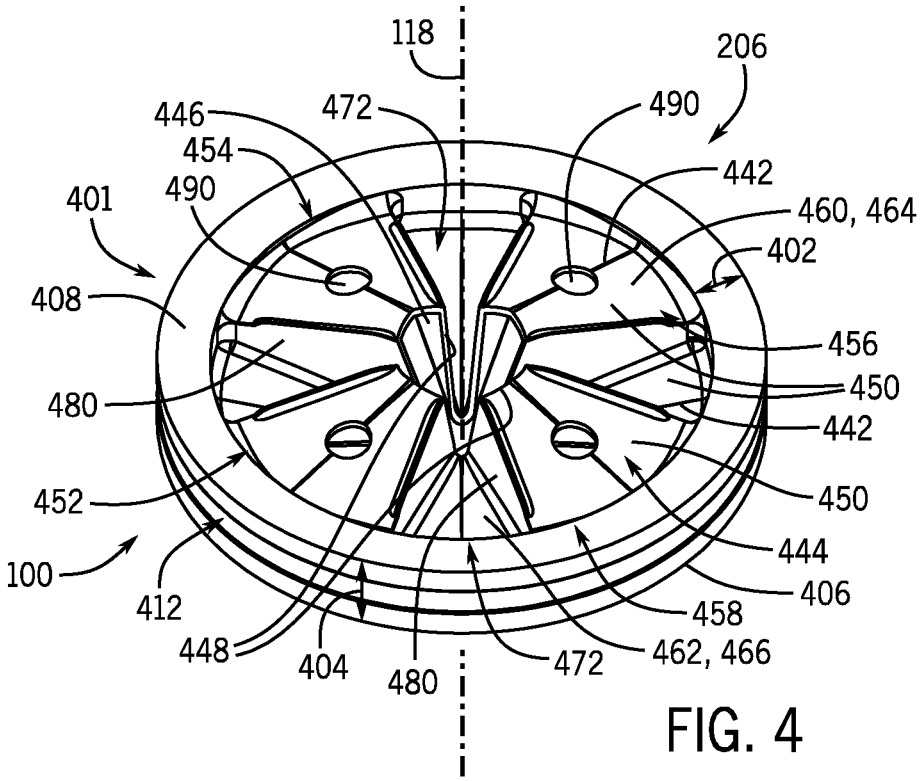
FIG. 4 is a first perspective view of the reversible baffle of FIGS. 1 through 3, in which the reversible baffle is oriented such that a first face of the reversible baffle is facing vertically upward in the same manner as shown in FIG. 2.
Figure 6:
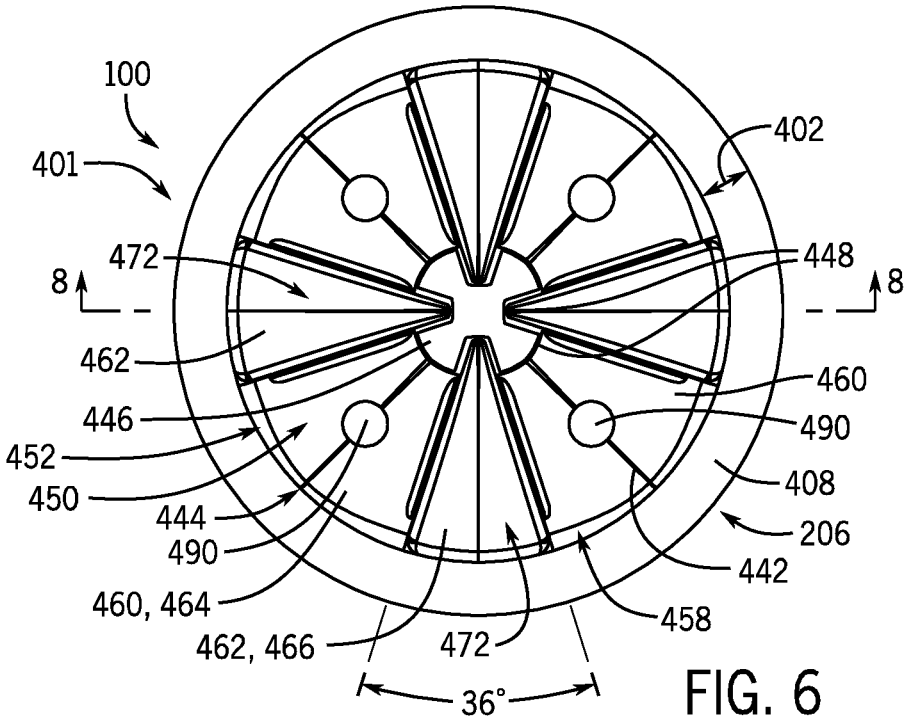
FIG. 6 is a cutaway plan view of a portion of the reversible baffle of FIGS. 1 through 5, in which the plan view particularly shows part of the first face of the reversible baffle that is also visible in FIGS. 2 and 4.
Figure 5:
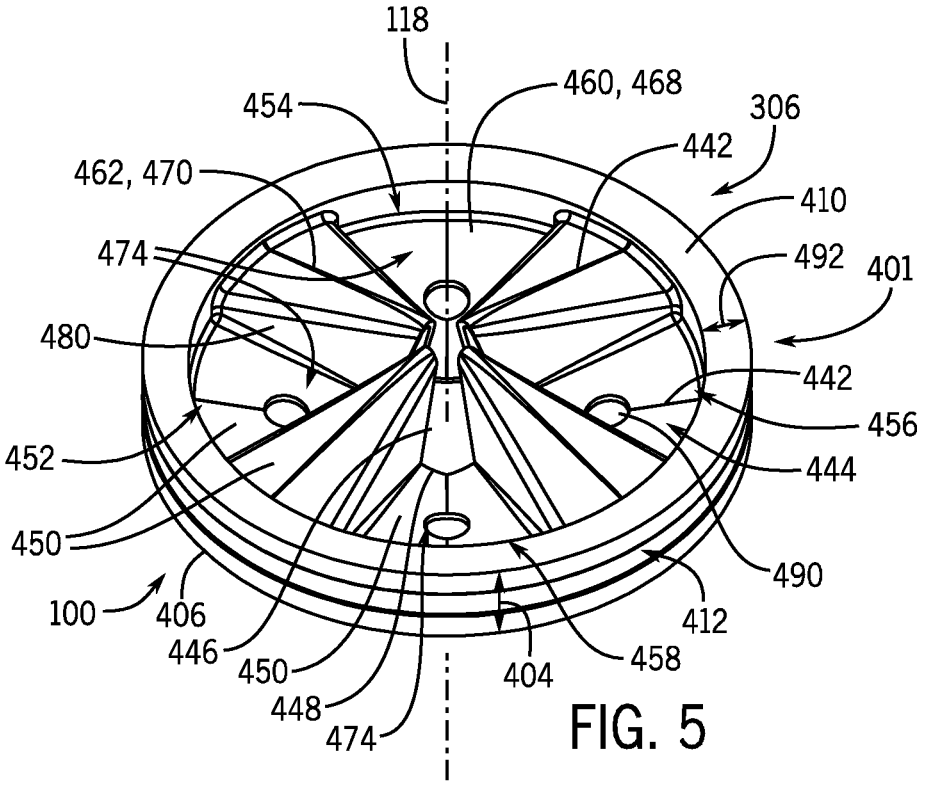
FIG. 5 is a second perspective view of the reversible baffle of FIGS. 1 through 4, in which the reversible baffle is oriented in an inverted manner relative to the orientation of the reversible baffle shown in FIG. 4, such that a second face of the reversible baffle is facing vertically upward in the same manner as shown in FIG. 3.

Referring now to FIG. 4, FIG. 5, FIG. 6, and FIG. 7, features of the reversible baffle 100 of FIG. 1, FIG. 2, and FIG. 3 are shown in more detail. FIG. 4 and FIG. 5 respectively show first and second perspective views of the reversible baffle 100, respectively, with the first perspective view of FIG. 4 showing the baffle in a position in which the first face 206 is primarily visible and the second perspective view of FIG. 5 showing the reversible baffle 100 in a position such that the second face 306 is primarily visible. The perspective views of the reversible baffle 100 that are respectively provided in FIG. 6 and FIG. 7 therefore are substantially consistent with the perspective views of the portions of the reversible baffle that are shown in FIG. 2 and FIG. 3, respectively. As for FIG. 6 and FIG. 7, these are cutaway plan views of the reversible baffle 100, with FIG. 6 particularly showing the first face 206 and FIG. 7 particularly showing the second face 306. FIG. 6 can be considered a cutaway top plan view of the reversible baffle 100 when in the position shown in FIG. 4, and FIG. 7 can be considered a cutaway top plan view of the reversible baffle 100 when in the position shown in FIG. 5.

Figure 7:
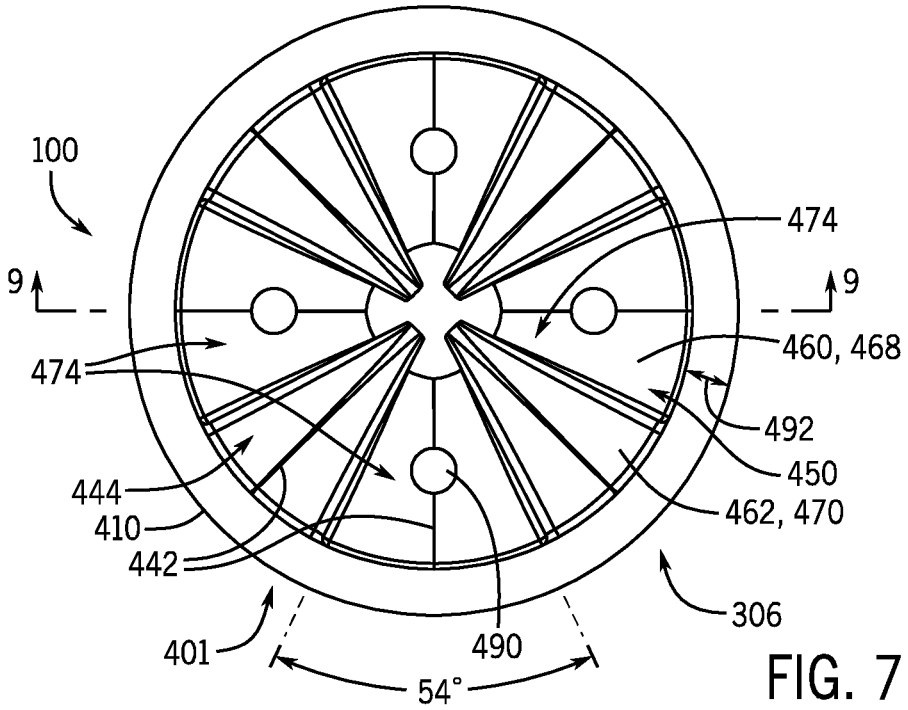
FIG. 7 is a cutaway plan view of a portion of the reversible baffle of FIGS. 1 through 6, in which the plan view particularly shows part of the second face of the reversible baffle that is also visible in FIGS. 3 and 5.

As illustrated by each of FIGS. 4, 5, 6, and 7, the reversible baffle 100 is disk-shaped and particularly includes a cylindrical rim 401 that extends around the central axis 118 of the baffle 100. The cylindrical rim 401 has a first radial extent or thickness 402 as shown in FIG. 4 and FIG. 6, a second radial extent or thickness 492 as shown in FIG. 5 and FIG. 7, and also an axial thickness or extent 404 as measured parallel to the central axis 118 as shown in FIG. 4 and FIG. 5. The cylindrical rim 401 further includes an outer cylindrical surface 406 that is configured to interface a complementary inner surface of the sink flange 112 when the reversible baffle 100 is implemented therein, regardless of the orientation of the reversible baffle relative to the sink flange. As shown, the outer cylindrical surface 406 particularly extends between a first annular edge 408 of the cylindrical rim 401 (see FIG. 4 and FIG. 6), which can be considered to constitute a part of the first face 206 and has the first radial extent 402, and a second annular edge 410 on the opposite side of the reversible baffle (see FIG. 5 and FIG. 7), which can be considered a part of the second face 306 and has the second radial extent 492.

In the present example embodiment, the outer cylindrical surface 406 particularly includes an annular dimple or groove (or depression) 412 that extends circumferentially around the entire cylindrical rim 401 and that is positioned midway or substantially midway between the first annular edge 408 and the second annular edge 410. The annular groove 412 is configured to receive therein a complementary annular protrusion or rib (not shown) that is formed along the inner cylindrical surface of the sink flange 112 when the reversible baffle 100 is fully positioned into the sink flange 112. By virtue of such interplay between the annular groove 412 and the complementary annular rib of the sink flange 112, the reversible baffle 100 can be positioned at a desired location relative to, supported by, and retained within (and fixed or substantially fixed in position relative to) the sink flange 112 once the rib of the sink flange has been received by the annular groove 412. In particular, the interplay of the annular groove 412 and complementary annular rib enable the reversible baffle to be relatively easily positioned, by a person installing the baffle, at a desired axial location (e.g., at a desired vertical level) within and axially along the sink flange 112 along the central axis 118 as shown in FIG. 1 (assuming that the central axis 118 is considered to be the central axis of the reversible baffle and the sink flange as described above).

Notwithstanding this description, however, it should be appreciated that in other embodiments encompassed herein the reversible baffle can have one or more other features in addition to or instead of the annular groove 412, and/or the sink flange can have one or more other features in addition to or instead of the complementary annular rib, that allow for the reversible baffle to be fixed in place relative to, supported by, and retained within the sink flange. Also, although the reversible baffle 100 is described above as having the cylindrical rim 401 and outer cylindrical surface 406 (and corresponding annular edges 408 and 410), in other embodiments encompassed herein the reversible baffle can take another form that is not cylindrical but rather is another shape. For example, in some other embodiments the reversible baffle can be oval in shape or substantially square in shape (e.g., generally square but with rounded corners). To the extent that the reversible baffle takes such other shapes, the baffle-less food waste disposer system will also be correspondingly modified, for example, to have a sink flange with an interior surface that is complementary to the shape of the baffle.

Referring still to FIGS. 4, 5, 6, and 7, in addition to the cylindrical rim 401 and associated features, the reversible baffle 100 additionally includes multiple pleats 450, which are structures that extend radially inwardly from the cylindrical rim 401 toward (but not all of the way up to) the central axis 118. More particularly as shown, the pleats 450 extend radially inwardly from the cylindrical rim 401 up to innermost edges or tips 448 of the pleats 450, and the tips 448 define a central orifice 446 that is positioned about the central axis 118. Although the pleats 450, by virtue of their extending radially inwardly toward the central axis 118, generally form portions of each of the first face 206 and the second face 306 (depending upon which of the alternate sides of the pleats one is viewing), the pleats are not planar structures in terms of the shapes of their surfaces extending radially inward toward the central axis. Rather, the pleats 450 are structures that have undulating (or wave-like) surfaces that vary in position along the axis 118, within and even beyond the axial extent 404. In particular, this undulating characteristic of the pleats 450 is apparent as one proceeds circumferentially around the central axis 118 from pleat to pleat and is visible if one views the pleats radially outwardly from the central axis 118.

In the present embodiment, the pleats 450 collectively form a web-like structure 444 that extends continuously, in an undulating manner, as one proceeds circumferentially around the central orifice 446 and central axis 118. Nevertheless, respective ones of the pleats 450 can be defined as respectively encompassing respective portions of the web-like structure 444 that respectively extend between the cylindrical rim 401 and one or more of the tips 448. For example, according to one definition, each of the pleats 450 is a respective portion of the web-like structure 444 that respectively extends angularly between a respective first angular position about the central axis 118 at which a single undulation (or full sine wave) of the web-like structure 444 begins and a respective second angular position about the central axis at which that single undulation ends (or at which a next identical or substantially identical undulation of the web-like structure begins).

Given such a definition of the respective extents of the respective pleats 450, the reversible baffle 100 of FIGS. 4, 5, 6 and 7 can be said to have first, second, third, and fourth pleats 452, 454, 456, and 458, where each of the respective pleats encompasses a respective quarter sector (or portion of a quarter sector, given that the pleats only extend up to the tips 448 and not all of the way inward to the central axis 118) of the web-like structure 444. Further, given the undulating nature of the pleats 450, it can be particularly seen that each of the pleats 452, 454, 456, and 458 can be defined, in terms of its respective angular extent, to include a respective first pleat portion 460 that is proximate or closer to the first annular edge 408 than to the second annular edge 410, and a respective second pleat portion 462 that is proximate or closer to the second annular edge 410 than to the first annular edge 408.

If defined (in terms of angular extent) in this manner, each of the first pleat portions 460 of each of the pleats 450 is situated adjacent to a respective one of the second pleat portions 462 of the respective pleat, and vice-versa. Further, if defined in this manner, each of the first pleat portions 460 of each of the pleats 450 is situated between the respective one of the second pleat portions 462 of that respective pleat and another one of the second pleat portions of a neighboring one of the pleats 450. Likewise, each of the second pleat portions 462 of each of the pleats 450 is situated between the respective one of the first pleat portions 460 of that respective pleat and another one of the first pleat portions of a neighboring one of the pleats 450. Thus, the reversible baffle 100 in the present embodiment includes four of the first pleat portions 460 and four of the second pleat portions 462, where each of the first pleat portions 460 is situated between two adjacent ones of the second pleat portions 462, and vice-versa.

Also, although not necessarily the case in all embodiments, in the present embodiment, each of the first and second pleat portions 460 and 462 includes a middle ridge 442 extending radially outward away from the central axis 118 along the length of the respective pleat portion. In the present embodiment, each respective middle ridge 442 is merely a junction between respective halves of each respective pleat portion on either side of the respective pleat portion, toward which each of the respective halves slightly slopes, and at which the respective halves are integrally connected with one another. Nevertheless, in other embodiments, one or more of the middle ridge(s) 442 are break lines (or splits) between the halves of the respective pleat(s), such that halves can experience movement apart from one another along the respective middle ridge(s).

Further, in terms of the relationship between the first and second pleat portions 460 and 462 and the first and second faces 206 and 306, it can be seen that the first face 206 particularly includes four first surface portions 464 formed respectively on the respective first pleat portions 460 and also includes four second surface portions 466 formed respectively on the respective second pleat portions 462. Correspondingly, the second face 306 includes four third surface portions 468 formed respectively on the respective first pleat portions 460 and also includes four fourth surface portions 470 formed respectively on the respective second pleat portions 462. Each of the first, second, third, and fourth surface portions 464, 466, 468, and 470 is flat or substantially (or largely) flat and is perpendicular or substantially perpendicular to the central axis 118. Thus, although the reversible baffle 100 includes four of the pleats 450, those pleats are structured such that each of the first and second faces 206 and 306 includes eight surface portions that respectively extend radially inwardly from the cylindrical rim 401 toward the central orifice 446 and that are substantially or largely perpendicular to the central axis 118.

Given the different axial positioning of the first and second pleat portions 460 and 462, those are not the only pleat portions of the pleats 450. Rather, the pleats 450 further include eight sidewall pleat portions (or simply sidewall portions) 480 in addition to the first and second pleat portions 460 and 462. As illustrated, the sidewall portions 480 connect each of the first pleat portions 460 with each of two of the second pleat portions 462 that are positioned on either side (as one proceeds circumferentially about the central axis 118) of the respective first pleat portions, and vice-versa. The sidewall portions 480 also extend radially inwardly from the cylindrical rim 401 toward the central axis 118, to the tips 448 and the central orifice 446. By virtue of the sidewall portions 480 linking the first pleat portions 460 with the second pleat portions 462, the first face 206 can be understood as including four first valleys 472 formed by the second pleat portions 462 and the sidewall portions 480 bounding each of those pleat portions respectively, in between respective pairs of the first pleat portions 460. Likewise, the second face 306 can be understood as including four second valleys 474 formed by the first pleat portions 460 and the sidewall portions 480 bounding each of those pleat portions respectively, in between respective pairs of the second pleat portions 462.

Given the presence of the sidewall portions 480, the first, second, third, and fourth surface portions 464, 466, 468, and 470 described above also are not the only surface portions of the pleats 450. Indeed, it should further be appreciated that, although not labeled with respective reference numbers in FIGS. 4, 5, 6, and 7, each of the sidewall portions 480 includes two opposed surface portions that are substantially or largely (albeit in the present embodiment, not exactly) axially extending surfaces that are parallel to the central axis 118. With respect to each of the sidewall portions 480, one of the opposed surface portions of that sidewall portion links one of the first surface portions 464 with one of the second surface portions 466 and can for this reason be considered a part of the first face 206. Also, with respect to each of the sidewall portions 480, the other of the opposed surface portions links one of the third surface portions 468 with one of the fourth surface portions 470 and can for this reason be considered a part of the second face 306.

Still referring to FIG. 4, FIG. 5, FIG. 6, and FIG. 7, and additionally to FIG. 8, FIG. 9, FIG. 10, FIG. 11, FIG. 12, FIG. 13, and FIG. 14, the reversible baffle 100 in the present embodiment includes multiple features that enable the baffle-less food waste disposer system 116, when supplemented by the reversible baffle, either to achieve sound reduced operation or to achieve high water flow operation as the improved food waste disposer system 10. A first of these features of the reversible baffle 100 that facilitates achieving such dual modes of operation has to do with the relative angular widths of the first and second valleys 472 and 474 formed respectively by the second and first pleat portions 462 and 460 in between adjacent ones of the sidewall portions 480. It will be appreciated that, during operation of the reversible baffle 100, water and other material passing through the improved food waste disposer system 10 first encounters the reversible baffle along that one of the faces 206 and 306 that is facing vertically upward. Due to gravity, such water (and other material) encountering the reversible baffle 100 further tends to flow along that one of the faces 206 and 306 that is facing vertically upward by way of those portions of the face that are more depressed (vertically lower) relative to other portions, radially inward toward and ultimately downward through the central orifice 446.

Thus, when the first face 206 is facing vertically upward (as would be the case in the configuration of the improved food waste disposer system 10, as shown in FIG. 2), water tends to flow primarily within the first valleys 472 formed by the second surface portions 466 of the second pleat portions 462 between adjacent ones of the sidewall portions 480 rather than on top of the first surface portions 464. Further, when the reversible baffle 100 is positioned so that the second face 306 is facing vertically upward (as would be the case in the configuration of the improved food waste disposer system 10, as shown in FIG. 3), water tends to flow primarily within the second valleys 474 formed by the third surface portions 468 of the first pleat portions 460 between adjacent ones of the sidewall portions 480 rather than on top of the fourth surface portions 470. Additionally, in regard to these manners of operation, it can be seen from a comparison of FIG. 7 with FIG. 6 that the first pleat portions 460 and thus the second valleys 474 in the present embodiment have an angular extent of 54 degrees, and that the second pleat portions 462 and thus the first valleys 472 have an angular extent of 36 degrees. In other example embodiments encompassed herein, the first pleat portions 460/second valleys 474 can have an angular extent that is in the range of 50° to 60°, and the first pleat portions 462/first valleys 472 can have an angular extent that correspondingly is in the range of 30° to 40°.

Given the aforementioned difference in angular extent between the first valleys 472 and second valleys 474, it can be appreciated that the rate of water flow atop the reversible baffle 100 and into the central orifice 446 will be somewhat restricted or impeded by the relative narrowness of the first valleys 472 when the first face 206 is facing vertically upward, relative to the rate of water flow atop the reversible baffle and into the central orifice that will occur by way of the second valleys 474 (given their relative wideness when the second face 306 is facing vertically upward). Correspondingly, there will be more of a tendency for water flowing by way of the first valleys 472 to back up and provide a sound reducing water layer atop the first face 206 of the reversible baffle 100 than will be the case when water is flowing by way of the second valleys 474. For these reasons, therefore, the relative widths of the first and second valleys 472 and 474 contribute to the ability of the reversible baffle 100 to foster sound reducing operation when implemented so that the first face 206 faces vertically upward as shown in FIG. 2, and to foster high water flow operation when implemented so that the second face 306 faces vertically upward as shown in FIG. 3.

Figure 8:
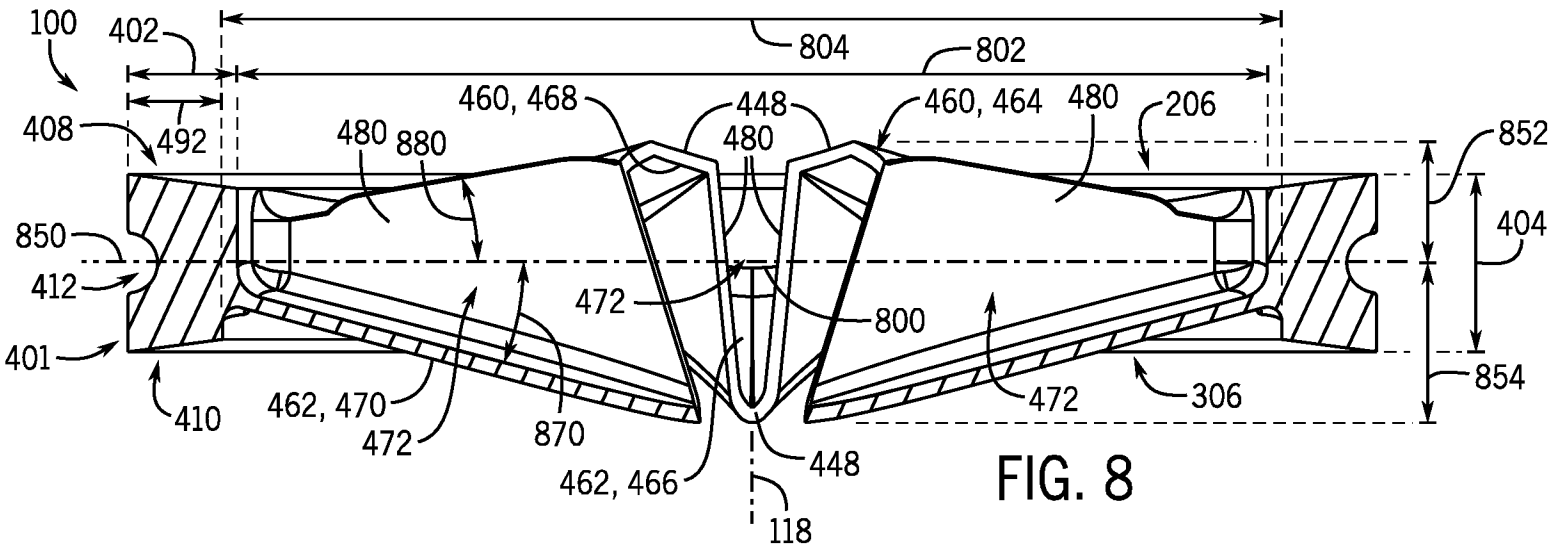
FIG. 8 is a cross-sectional view of the reversible baffle of FIGS. 1 through 7, taken along line 8-8 of FIG. 6.
Figure 9:
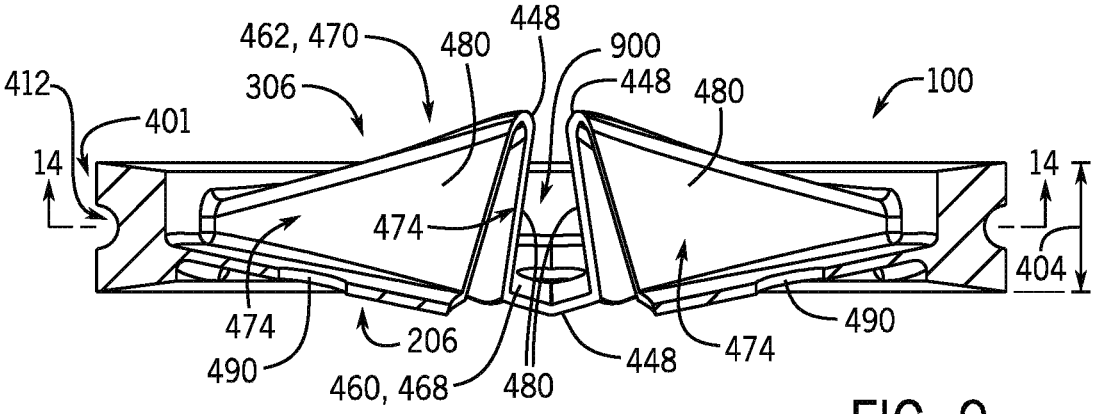
FIG. 9 is a cross-sectional view of the reversible baffle of FIGS. 1 through 8, taken along line 9-9 of FIG. 6.

Turning to FIGS. 8 and 9, cross-sectional views of the reversible baffle 100 taken along line 8-8 of FIG. 6 and along line 9-9 of FIG. 7, respectively, are shown. The cross-sectional views provided in FIG. 8 and FIG. 9 particularly are intended to illustrate a second feature of the reversible baffle 100 that also enables the improved food waste disposer system 10 to operate in the sound reducing mode when the reversible baffle is implemented in the first orientation of FIG. 2 and also to operate in the high water flow mode when the reversible baffle is implemented in the second orientation of FIG. 3. As already discussed, when the reversible baffle 100 is in the first orientation shown in FIG. 2, such that the first face 206 is facing vertically upward, water tends to flow through the first valleys 472. As particularly illustrated by FIG. 8, it will be appreciated that as water (not shown) proceeds through the first valleys toward the central orifice 446, the water ultimately will pass through relatively narrow width openings between the neighboring pleats—that is, narrow width openings 800 formed between the neighboring sidewall portions 480 on either side of the second surface portions 466 at the tips 448 of the pleats 450.

By contrast, when the reversible baffle 100 is in the second orientation shown in FIG. 3, such that second face 306 is facing vertically upward, water tends to flow through the second valleys 474. As particularly illustrated by FIG. 9, it will be appreciated that as the water proceeds through the second valleys toward the central orifice 446, the water ultimately will pass through relatively wide openings between the neighboring pleats—that is, openings 900 (one of which is shown in FIG. 9) formed between the neighboring sidewall portions 480 on either side of the third surface portions 468 at the tips 448 of the pleats 450. As can be appreciated from a comparison of FIG. 8 and FIG. 9, the width of the openings 900 is substantially greater than the width of the narrow width openings 800. In at least some embodiments, the width of each of the narrow width openings 800 can be in range of 0.030 inches to 0.250, and in the present example embodiment is 0.125 inches. By contrast, in at least some embodiments, the width of each of the openings 900 can be in the range of 0.080 inches to 0.350 inches, and in the present example embodiment is 0.210 inches.

Because of this width difference between the narrow width openings 800 and the openings 900, the reversible baffle 100 when in the first orientation of FIG. 2 (with the first face 206 facing vertically upward) tends to restrict water flow into the central orifice 446 and tends to achieve corresponding sound reduction to a greater extent than when in the second orientation of FIG. 3 (with the second face 306 facing vertically upward). That is, the relative narrowness of the narrow width openings 800 slows the water flow to help create the water dam for sound reduction. Conversely, given that the openings 900 have a width that is greater than that of the narrow width openings 800, the reversible baffle 100 tends to permit higher water flow into the central orifice 446 when in the second orientation of FIG. 3 than when in the first orientation of FIG. 2. That is, the relative wideness of the second valleys 474 and the openings 900 associated therewith allows for improved water flow as well as food passage by comparison with what would occur by way of the first valleys 472 and narrow width openings 800.

Still referring to FIG. 8, that cross-sectional view further illustrates two additional features of the reversible baffle 100 that foster achieving both sound reducing operation and high water flow operation. In particular, FIG. 8 not only shows that the first annular edge 408 has the first radial extent 402 and that the second annular edge 410 has the second radial extent 492, but also correspondingly shows that the reversible baffle 100 has two inner diameters of the cylindrical rim 401 and correspondingly has two outer diameters of the pleats 450. Along the first face 206, which includes the first annular edge 408 having the first radial extent 402, the cylindrical rim 401 and first annular edge 408 have a first inner diameter 802. The first inner diameter 802 also constitutes a first outer diameter of the pleats 450, and thus constitutes the outer diameter of the first surface portions 464 of the first pleat portions 460 and the second surface portions 466 of the second pleat portions 462. By contrast, along the second face 306, which includes the second annular edge 410 having the second radial extent 492, the cylindrical rim 401 and second annular edge 410 have a second inner diameter 804. The second inner diameter 804 also constitutes a second outer diameter of the pleats 450, and thus constitutes the outer diameter of the third surface portions 468 of the first pleat portions 460 and the fourth surface portions 470 of the second pleat portions 462.

As further shown by FIG. 8, the first radial extent 402 is greater than the second radial extent 492, and correspondingly the second inner diameter 804 is larger in size than the first inner diameter 802. In at least some embodiments, the difference in size between the first and second inner diameters 802 and 804 is between 0.050 inches and 0.150 inches, and in the present example embodiment the difference in size between those diameters is 0.100 inches. Given these differences, the pleats 450 have a greater radial extent along the second face 306 than along the first face 206, and more particularly the third surface portions 468 and the fourth surface portions 470 extend radially outward away from the central axis 118 a greater distance than do the first surface portions 464 and second surface portions 466. Given this to be the case, it should be appreciated that the shape of the first face 206, with the first inner diameter 802 being smaller than the second inner diameter 804, tends to displace water that is situated atop the first face when the reversible baffle 100 is in the first orientation corresponding to FIG. 2. Such displacement of water tends to increase the height of any water dam formed above the first face 206 of the reversible baffle 100, and correspondingly tends to enhance sound reduction. By comparison, because the second inner diameter 804 is larger than the first inner diameter 802, there does not occur as much water displacement atop the second face 306 when the reversible baffle 100 is in the second orientation corresponding to FIG. 3, which is consistent with higher water flow operation.

Additionally referring to FIG. 8, in the present embodiment of the reversible baffle 100, the first and second pleat portions 460 and 462 are generally positioned axially outward away from a mid-plane 850 (or middle axis) of the reversible baffle 100, where the mid-plane is perpendicular to the central axis 118 as shown. Further, each of the first and second pleat portions 460 and 462 tends to extend generally farther away from the mid-plane 850 as the respective pleat portion extends closer to the central axis 118, and thus it is the tips 448 of the pleats 450 that are the portions of the pleats that are farthest from the mid-plane. Relatedly, each of the sidewall portions 480 increases in its axial extent as it extends radially inwardly. With the pleats 450 shaped in this manner, the reversible baffle 100 is configured so that water tends to flow vertically downward as it flows radially inward through the first valleys 472 to the central orifice 446, when the reversible baffle 100 is in the first orientation with the first face 206 facing vertically upward. Likewise, with the pleats 450 shaped in this manner, the reversible baffle 100 also is configured so that water tends to flow vertically downward also as it flows radially inward through the second valleys 474 to the central orifice, 446, when the reversible baffle 100 is in the second orientation with the second face 306 facing vertically upward.

Further as is evident from FIG. 8, in the present embodiment, the first and second pleat portions 460 and 462 extend axially outward away from the mid-plane 850 to different extents. As shown, the tips 448 of the first pleat portions 460 (which again are the portions of the first pleat portions 460 that are farthest from the mid-plane 850) are positioned axially outward from the mid-plane 850 by a first axial extent 852. By comparison, the tips 448 of the second pleat portions 462 (which again are the portions of the second pleat portions 462 that are farthest from the mid-plane 850) are positioned axially outward from the mid-plane 850 by a second axial extent 854. As illustrated, the second axial extent 854 is greater than the first axial extent 852. Further, given that the first axial extent 852 is smaller than the second axial extent 854, the first valleys 472 and particularly the second surface portions 466 therewithin exhibit an angle 870, as measured relative to the mid-plane 850 as one proceeds radially-inwardly toward the central axis 118, which is steeper than an angle 880 of the second valleys 474 and particularly the third surface portions 468 therewithin, as measured relative to the mid-plane as one proceeds radially-inwardly toward the central axis.

These differences, between the first axial extent 852 and second axial extent 854 and corresponding differences between the angle 880 and angle 870, again tend to foster operation by the improved food waste disposer system 10 in each of the sound reducing mode and the high water flow mode depending upon the orientation of the reversible baffle 100. This is particularly the case when one combines the effects of these axial extents/angles with the relative sizes of the narrow width openings 800 and openings 900. Indeed, when the reversible baffle 100 is in the first orientation of FIG. 2, such that water tends to flow toward the central orifice 446 via the first valleys 472 and particularly the second surface portions 466—which is consistent with the view provided by FIG. 8—the shape of the first valleys 472 and second surface portions 466 tends to slow water migration in a manner consistent with the sound reducing mode of operation Even though the steeper pleat valleys will be more effective at channeling water toward the central orifice 446, the narrow width openings 800 at the ends of the first valleys 472 will be restrictive to water flow and tend to produce more water coverage over the baffle, which will result in increased sound reduction. As the water flow occurs, the water will back up in the first valleys 472 due to the restrictive effect of the narrow width openings 800 and will create a water layer over the baffle.

By contrast, when the reversible baffle 100 is in the second orientation of FIG. 3, the second valleys 474 are shallower. Even though this might seem to be less effective at channeling water into the central orifice 446, because the openings 900 at the ends of the second valleys 474 are broader, the overall arrangement is less restrictive to water flow than the arrangement of FIG. 2. That is, when the reversible baffle 100 is in the second orientation of FIG. 3, such that water tends to flow toward the central orifice 446 via the second valleys 474 and particularly the third surface portions 468—which would be consistent with an inverted view of FIG. 8 such as that provided by FIG. 9—the shape of the second valleys 474 and third surface portions 468 in combination with the size of the openings 900 tends to improve flow in a manner consistent with the high water flow mode of operation.

Figure 11:
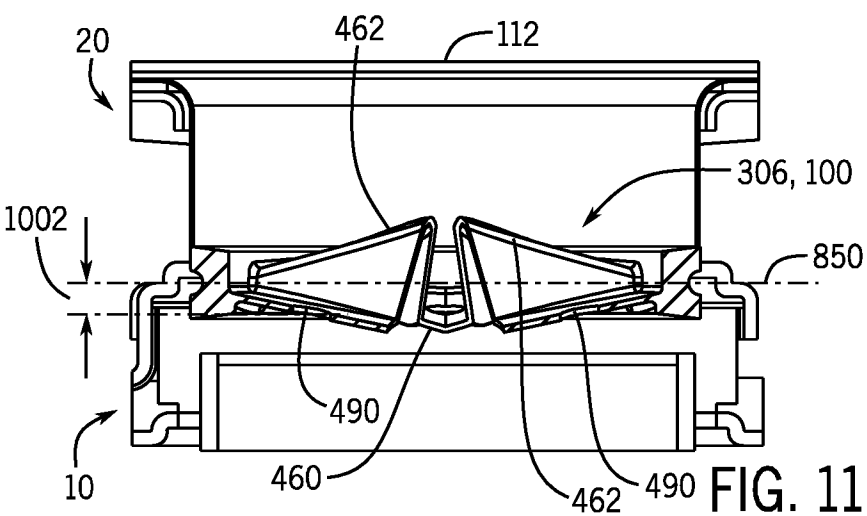
FIG. 11 is a cutaway cross-sectional view of the reversible baffle of FIGS. 1 through 10 when implemented, in relation to the same portions of the improved food waste disposer system and the sink as shown in FIG. 10, in a manner that is inverted in orientation relative to the orientation of the reversible baffle shown in FIG. 10.
Figure 10:
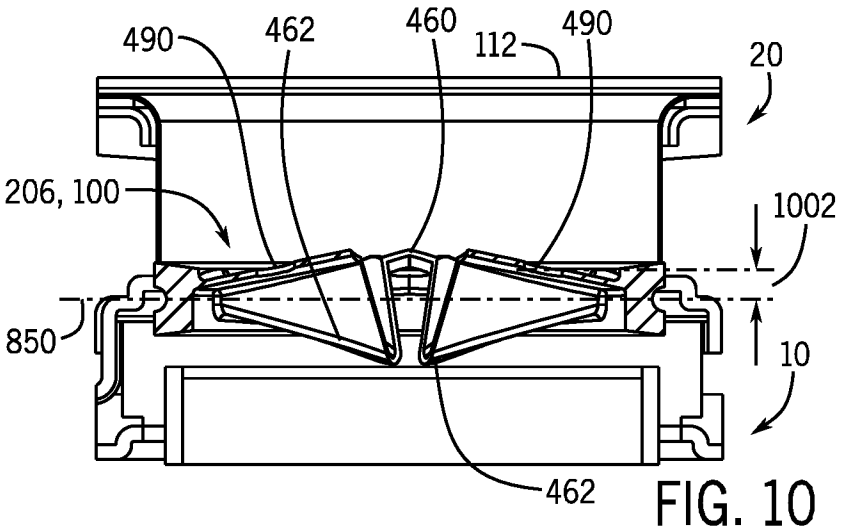
FIG. 10 is a cutaway cross-sectional view of the reversible baffle of FIGS. 1 through 9 when implemented, in relation to portions of the improved food waste disposer system and the sink of FIGS. 1 through 3 in the same manner (with the same orientation) as is shown in FIG. 2, where the cross-sectional view of the reversible baffle is the same as that shown in FIG. 8.

Referring additionally to FIG. 10 and FIG. 11, additional cross-sectional views are provided of the reversible baffle 100 when it is situated within the sink flange 112 of the improved food waste disposer system 10 in relation to the sink 20. FIG. 10 provides a first cross-sectional view showing the reversible baffle 100 to be in the same, first orientation that is shown in FIG. 2, and FIG. 10 provides a second cross-sectional view showing the reversible baffle 100 to be in the same, second orientation that is shown in FIG. 3. It should be appreciated that the cross-section of FIG. 10 is taken along a line that is both the same as that used to determine the cross-section of the sink flange 112 and the reversible baffle 100 of FIG. 2. By comparison, FIG. 11 provides an alternate cross-sectional view that is identical to the view of FIG. 10 except insofar as the reversible baffle 100 is shown to be in its inverted, second orientation in which the second face 306 is facing vertically upward. Thus, it should be noted that the sections of the first and second pleat portions 460 and 462 that are visible in FIG. 10 are exactly the same as those shown in FIG. 11 except insofar as the view of those pleat portions is flipped relative to the mid-plane 850 of the baffle 100. It should further be appreciated from a comparison of FIG. 11 with FIG. 9 that the cross-sectional view of the reversible baffle 100 shown in FIG. 11 is identical to that shown in FIG. 9, and thus corresponds to line 9-9 of FIG. 7 along which the cross-sectional view of FIG. 9 is taken. Accordingly, the cross-sectional view of the reversible baffle 100 shown in FIG. 10 is inverted relative to that shown in FIG. 9.

It should also be appreciated from FIGS. 8, 9, 10, and 11 that the annular groove 412 of the reversible baffle 100 is positioned so as to be exactly or substantially midway along the axial extent 404 between the first and second annular edges 408 and 410, such that the annular groove is exactly or substantially aligned with the mid-plane 850 of the reversible baffle 100. Given this positioning of the annular groove 412 relative to the mid-plane 850, as illustrated particularly by FIG. 10 and FIG. 11, the reversible baffle 100 overall tends to be positioned at the same or substantially the same vertical level within the sink flange 112 as viewed relative to the central axis 118 regardless of whether the reversible baffle is in the first orientation corresponding to FIG. 2 or in the second orientation corresponding to FIG. 3. This is not to say that the uppermost portions and lowermost portions of the reversible baffle 100 are at the same vertical levels within the sink flange 112 depending upon the orientation of the baffle. Because the first and second axial extents 852 and 854 are different, depending upon the orientation of the baffle, the uppermost portions and lowermost portions of the baffle will be at different locations depending upon whether the baffle is in the first orientation in which the first face 206 faces vertically upward or in the second orientation in which the second face 306 faces vertically upward.

In view of FIG. 10 and FIG. 11, as well as FIGS. 4 through 9, an additional feature of the reversible baffle 100 that enables the reversible baffle to provide both sound reducing operation when in the first orientation of FIG. 2 and also high water flow operation when in the second (inverted) orientation of FIG. 3 is the positioning of water flow holes (or drain holes) 490 within the pleats 450. In particular, the pleats 450 have four of the water flow holes 490. In the present example embodiment, each of the water flow holes has a diameter in the range of 0.200 inches to 0.300 inches, for example, each of the water flow holes can have a diameter of 0.250 inches. As is evident from FIGS. 4, 5, 6, and 7, the water flow holes 490 are particularly provided on the first pleat portions 460 rather than on the second pleat portions 462. More particularly, the water flow holes 490 are formed approximately midway between the cylindrical rim 401 and the tips 448 of the first pleat portions 460, in terms of the radial spacing of the water flow holes. Additionally, the water flow holes 490 provided on the first pleat portions 460 are positioned approximately midway between the respective sidewall portions 480 that form the sides of each of the first pleat portions. Given that the first pleat portions 460 include the central radially-extending middle ridges 442, in the present example embodiment, the water flow holes 490 can be centered along those middle ridges, with a range of 0.200 inches inward or outward.

The positioning of the water flow holes 490 again tends to foster the sound reducing operation by the reversible baffle 100 when the baffle is positioned so that the first face 206 is facing upward, and tends to foster high water flow operation when the baffle is in the alternate position such that the second face 306 faces vertically upward. When the reversible baffle 100 is arranged relative to the sink flange 112 so that the first face 206 faces vertically upward as shown in FIG. 2, FIG. 8, and FIG. 10, the water flow holes 490 are positioned on the first pleat portions 460 near the first axial extent 852 that is the highest vertical extent of the reversible baffle in that orientation. More particularly as shown in FIG. 10, in this first orientation, the water flow holes 490 (or centers of those holes) are positioned at a distance 1002 above the mid-plane 850. When in this orientation, such that the water flow holes 490 are above the mid-plane, relatively little water collects on top of the first surface portions 464 associated with the first pleat portions 460 through which the water flow holes 490 pass. Thus, relatively little water passes through the water flow holes 490 when the reversible baffle 100 is in the first orientation corresponding to the sound reducing mode. Stated in another manner, when in this orientation, the water flow holes 490 are positioned at, or substantially at, the tops of the pleats 450 such that sound reducing operation can occur without being significantly undermined by the presence of the water flow holes.

Relatedly, in this orientation, initially as the water flows into the disposer, the water flow holes 490 on the top of the first pleat portions 460 will serve as vents for the trapped air (in the grinding chamber). The sound waves created by the interaction of food waste with the grind chamber and grind mechanism will not travel as efficiently through an air-water interface due to the impedance change at the interface as they do through air only (or water only). The water layer over the baffle openings will create an air-water interface that helps to reduce the sound transmitted from the grind chamber to the user during the grinding operation.

In contrast, when the reversible baffle 100 is positioned in the second orientation such that the second face 306 is facing vertically upward as shown in FIG. 3, FIG. 9, and FIG. 11, the water flow holes 490 (or centers of those holes) again are positioned at the distance 1002 relative to the mid-plane 850, except in this circumstance the water flow holes are positioned at the distance 1002 beneath the mid-plane rather than above the mid-plane. Further, the water flow holes 490 extend through the third surface portions 468 within the second valleys 474 through which water tends to flow when the reversible baffle 100 is in this second orientation. Consequently, when positioned in this manner, water not only tends to flow through the second valleys 474 toward the central orifice 446 and then down through that central orifice, but also tends to pass directly downward through the water flow holes 490, and thus greater water flow is achieved. That is, the water flow holes 490 in the floors of the second valleys 474 provide paths for water to enter the disposer that are supplemental to those provided by the openings 900 and central orifice 446, and thereby allow a higher water flow into the disposer grinding chamber without water backup over the baffle. Thus, the positioning of the water flow holes 490 again fosters high water flow operation when the reversible baffle 100 is in its second orientation corresponding to the high water flow mode. Stated in another manner, when in this orientation, the water flow holes 490 are positioned at or substantially at the bottoms of the pleats 450, thus contributing to high water flow operation.

It should be appreciated that the exact sizes and arrangements of the water flow holes 490 can vary depending upon the embodiment. In at least some embodiments, the distance 1002 can be in the range of 0.250 inches to 0.550 inches and, in the present example embodiment, the distance 1002 is 0.400 inches. In alternate embodiments, the distance 1002 can be half any of these amounts. Also, in at least some other embodiments, more than one water flow hole can be present on each of the first pleat portions 460. Further it should be appreciated that, regardless of the orientation of the reversible baffle 100 and size of the distance 1002 (or height difference relative to the mid-plane 850), the water flow holes 490 also allow for air to escape the grind chamber of the food waste disposer 60. Allowing for air to escape in this manner can particularly facilitate high water flow operation insofar as trapped air can cause water to back up.

Figure 12:
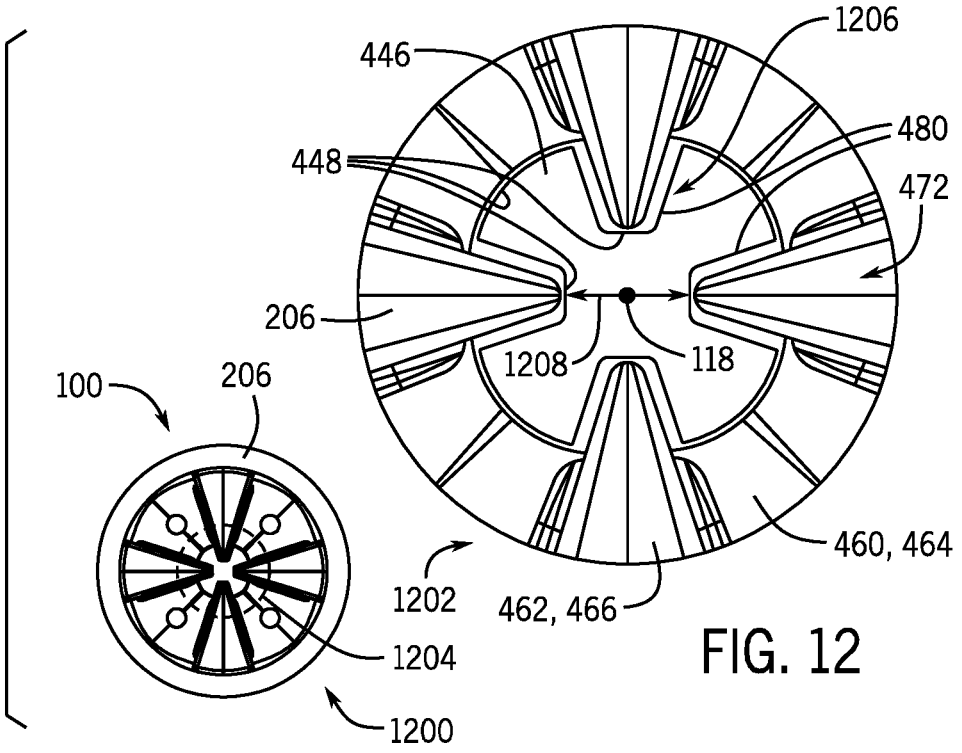
FIG. 12 is an additional plan view of the reversible baffle of FIGS. 1 through 11 in which the reversible baffle has the same orientation as that shown in FIGS. 2, 4, and 6 and the plan view particularly shows the first face of the reversible baffle that is also visible in FIGS. 4 and 6, in combination with a detail view of an inner circular portion of that plan view.
Figure 13:
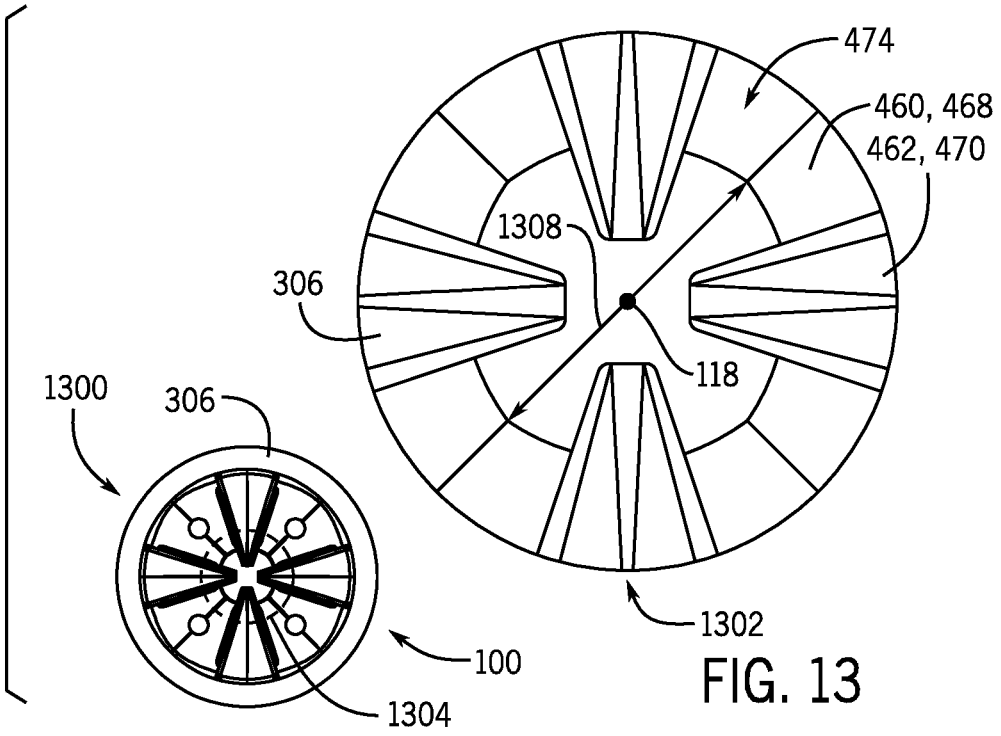
FIG. 13 is an additional plan view of the reversible baffle of FIGS. 1 through 12 in which the reversible baffle has an inverted orientation relative to that shown in FIG. 12 such that the plan view particularly shows the second face of the reversible baffle that is also visible in FIGS. 5 and 7, in combination with a detail view of an inner circular portion of that plan view.

Turning next to FIG. 12 and FIG. 13, operation of the reversible baffle 100 to achieve each of sound reducing behavior when in the first orientation of FIG. 2 (with the first face 206 facing upward) and higher water flow behavior when in the second orientation of FIG. 3 (with the second face 306 facing upward) is also fostered by an additional feature of the reversible baffle in the present embodiment. FIG. 12 particularly shows a plan view 1200 of the reversible baffle 100 when in its first orientation in which the first face 206 is facing upward (e.g., consistent with the plan view of FIG. 6), and additionally shows a detail view 1202 of a central portion of the reversible baffle demarcated by a circle 1204 shown in the plan view. The size of detail view 1202 is expanded by a three-to-one ratio relative to the plan view 1200. In particular, the detail view 1202 illustrates the tips 448 of the pleats 450 and further shows how those tips define the central orifice 446 of the reversible baffle. Of particular note in the detail view 1202 are interior edges 1206 that border and define the central orifice 446. It should be appreciated from the earlier description that the interior edges 1206 are formed in part by the sidewall portions 480 that extend between adjacent ones of the first pleat portions 460 and second pleat portions 462. Particularly along the sides of the tips 448 of the second pleat portions 462, the sidewall portions 480 tend to define the width of those pleat portions as one proceeds vertically downward along the central axis 118.

In contrast, FIG. 13 shows a plan view 1300 of the reversible baffle 100 when it is in its second orientation in which the second face 306 is facing upward (e.g., consistent with the plan view of FIG. 7), and additionally shows a detail view 1302 of a central portion of the reversible baffle demarcated by a circle 1304 shown in the plan view. Again, the size of detail view 1302 is expanded by a three-to-one ratio relative to the plan view 1300. It should be appreciated from the description concerning FIG. 12 and otherwise above that the sidewall portions 480 still are present in the structure of FIG. 13, and that the sidewall portions 480 tend to broaden circumferentially outward from the second pleat portions 462 as one proceeds from the second face 306 toward the first face 206 along the central axis 118. It will also be appreciated from FIG. 12 and FIG. 13 that the tips 448 of the second pleat portions 462 extend radially inwardly towards the central axis 118 farther than the tips of the first pleat portions 460. Indeed, as shown in FIG. 12, the tips 448 of diametrically-opposed ones of the second pleat portions 462 are a first diameter 1208 apart from one another, while the tips of diametrically-opposed ones of the first pleat portions 460 are a second diameter 1308 apart from one another. Correspondingly, each of the respective tips 448 of each of the second pleat portions 462 is located at a first radius outward from the central axis 118, where the first radius is half of the first diameter 1208, and each of the respective tips 448 of each of the first pleat portions 460 is located at a second radius outward from the central axis 118, where the second radius is half of the second diameter 1308.

In view of these characteristics of the reversible baffle 100 that are evident from FIG. 12 and FIG. 13, the central orifice 446 is experienced differently by water depending upon whether the reversible baffle is in its first orientation or second orientation. Even though the central orifice 446 has the same outline or perimeter when viewed from the plan view of FIG. 12 as from the plan view of FIG. 13, the effective size of the central orifice 446 experienced by water entering the central orifice differs depending upon the orientation of the reversible baffle due to the shapes of the pleats 450 (and particularly the tips 448 thereof). More particularly, when water flows along the first face 206 of the reversible baffle 100 when the reversible baffle is in the first orientation of FIG. 2, the water travels through the first valleys 472 to the tips 448 of the second pleat portions 462 and thus enters the central orifice 446 at locations where the central orifice has an effective diameter of the first diameter 1208. In contrast, when water flows along the second face 306 of the reversible baffle 100 when the reversible baffle is in the second orientation of FIG. 3, the water travels through the second valleys 474 to the tips 448 of the first pleat portions 460 at locations where the central orifice has an effective diameter of the second diameter 1308.

Because the first diameter 1208 is smaller than the second diameter 1308 (and, correspondingly, because the aforementioned first radius equaling half of the first diameter is smaller than the aforementioned second radius equaling half of the second diameter), water flowing into the central orifice 446 experiences different effective central orifices depending upon whether the reversible baffle 100 is in the first orientation of FIG. 2 or the second orientation of FIG. 3. In particular, water flowing through the first valleys 472 when the reversible baffle 100 is in the first orientation of FIG. 2 experiences an effective central orifice that is smaller in size than an effective central orifice experienced by water flowing through the second valleys 474 when the reversible baffle is in the second orientation of FIG. 3. Consequently, when the reversible baffle 100 is in the first orientation of FIG. 2 corresponding to the sound reducing mode, water flow into and through the central orifice 446 is effectively restricted to a certain extent, which additionally contributes to sound reduction. However, when the reversible baffle 100 is in the second orientation of FIG. 3 corresponding to the high water flow mode, the tips 448 of the pleats 450 surrounding the central orifice 446 are tapered so that water flows more easily into and through the central orifice 446, which fosters higher water flow.

Given how the shapes of the pleats 450 (and particularly the tips 448 thereof) impact how the central orifice 446 is experienced depending upon the orientation of the reversible baffle 100, the aforementioned feature involving a central orifice that effectively varies depending upon the orientation of the reversible baffle can also be referred to as a drafted center hole. That is, the central orifice 446 is drafted so that it effectively has a larger opening (or hole) at its bottom when the reversible baffle 100 is in the second orientation of FIG. 3 so as to improve flow, but has a smaller more restrictive opening (or hole) at its bottom when the reversible baffle is in the first orientation of FIG. 2, so as to reduce water flow and contribute to sound reduction. Also it should be appreciated that, because the tips 448 of the second pleat portions 462 extend radially inwardly farther than the tips of the first pleat portions 460, the second pleat portions 462 (and the tips thereof) tend to extend physically over the larger opening (or hole) having the second diameter 1308 when the reversible baffle is in the second orientation shown in FIG. 3. Consequently, due to the central orifice 446 being drafted, the present embodiment of the reversible baffle 100 in a sense can be understood as having pleats (or tips of pleats) that extend physically over the central orifice 446, or that at least extend physically over the larger-sized opening associated with the central orifice due to the drafting of that central orifice.

The actual drafting of the central orifice 446, and the pleats 450 forming the central orifice 446, can vary depending upon the embodiment. In at least some embodiments encompassed herein, a draft angle for the central orifice can be understood to be an angle, as measured relative to a vertical axis parallel to the central axis 118, of an edge portion (of the interior edges 1206) linking one of the tips 448 of one of the first pleat portions 460 with one of the tips of an adjacent one of the second pleat portions 462. Also, in at least some embodiments encompassed herein, the draft angle can be between 10 degrees and 25 degrees, and in at least one embodiment encompassed herein the draft angle has a value of 18 degrees of draft.

The aforementioned features of the reversible baffle 100, particularly those described above in relation to FIG. 4 through FIG. 13, all tend to foster dualistic operation of the reversible baffle 100 in each of the sound reducing mode and the high water flow mode. Nevertheless, the reversible baffle 100 can also include one or more other features that achieve other objective(s) as well. In particular with respect to FIG. 14, a cross-sectional view 1400 of the reversible baffle 100 is shown, with that cross-section being taken along a line 14-14 of FIG. 9. Additionally, FIG. 14 also includes a detail view 1402 of the reversible baffle 100 that corresponds to a portion of the cross-sectional view 1400 as demarcated by a circle 1404, where the detail view is enlarged by a ratio of two-to-one relative to the cross-sectional view. As illustrated, the detail view 1402 particularly encompasses a portion of the cylindrical rim 401 and most of a single one of the second pleat portions 462.

Figure 14:
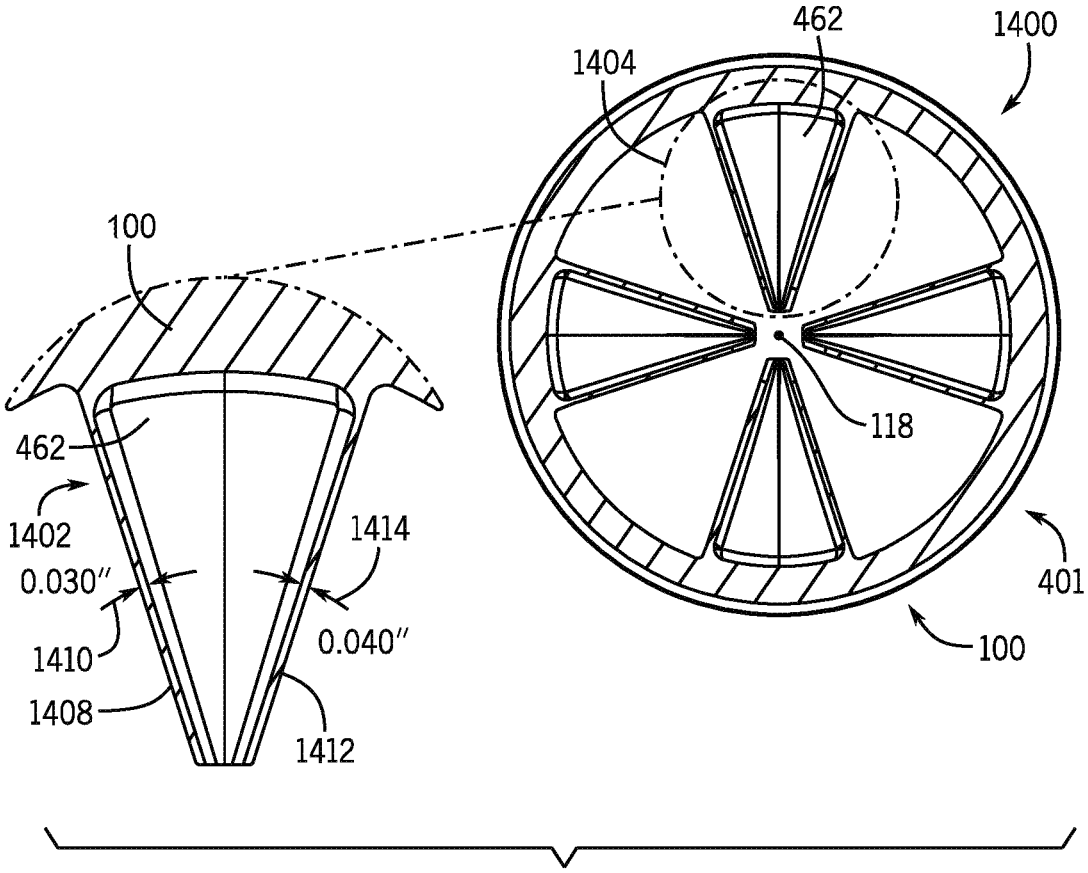
FIG. 14 is a cross-sectional view of the reversible baffle of FIGS. 1 through 13 taken along line 14-14 of FIG. 9, in combination with a detail view of a circular portion of that cross-sectional view.

FIG. 14 particularly illustrates that, generally speaking, it is not necessary that the nitrile rubber or other material forming the reversible baffle 100 and particularly the pleats 450 thereof have a consistent thickness throughout all locations along the reversible baffle or the pleats. Indeed, although in some embodiments it is possible that all or various different portions of the pleats 450 can employ nitrile rubber (or other material) that is of a consistent thickness or has the same thickness throughout the pleats, in other embodiments including the present example embodiment it is particularly the case that at least the sidewall portions 480 have varying thicknesses. More particularly, as shown in FIG. 14, a left one 1408 of the sidewall portions 480 associated with the second pleat portion 462 shown in the detail view 1402 has a thickness of 0.030 inches as illustrated by arrows 1410, but a right one 1412 of the sidewall portions associated with that second pleat portion has a relatively larger thickness of 0.040 inches as represented by arrows 1414.

Although only a single one of the second pleat portions 462 is shown in the detail view 1402, it should also be appreciated that each of the other ones of the second pleat portions 462 shown in the cross-sectional view 1400 is also associated with a first sidewall portion having the smaller 0.030 inch thickness and a second sidewall portion having the relatively larger 0.040 inch thickness. In the present embodiment, with respect to each of the second pleat portions 462, it can be a left one of the sidewall portions associated with that second pleat portion that is the sidewall portion that has the smaller width and the right one of the sidewall portions associated with that second pleat portion that has the larger width (where, as viewed in FIG. 14, the left sidewall portion and right sidewall portion can respectively be considered to be positioned counterclockwise and clockwise about the central axis 118 relative to the second pleat portion in question). However, it should be appreciated that this embodiment is merely an example and that, in other embodiments, the relative thicknesses of the two sidewall portions associated with any given pleat portion can be reversed relative to that described in regard to the detail view 1402, and also that the particular thicknesses of any of the sidewall portions can vary from the example thicknesses of 0.030 inches and 0.040 inches described above.

By providing pleat portions such as the second pleat portions 462 in which the two sidewall portions 480 associated with each given pleat portion has a different thickness relative to the other as shown in FIG. 14, an additional functional objective can be achieved. As mentioned above, the reversible baffle 100 in the present embodiment includes a drafted center hole, in which at least some of the tips 448 of the pleats 450 extend over the central orifice 446 (or at least over the larger opening of the central orifice having the second diameter 1308) when the reversible baffle is in the second orientation of FIG. 3. Given this arrangement of the pleats 450, and absent some other countervailing design feature, it would be possible for the pleats of the reversible baffle to become bi-stable structures that would have both a normal stable position and a secondary stable position, such as an "over-dash center" position.

Nevertheless, the present embodiment of the reversible baffle 100 does have such a countervailing design feature—namely, the different wall thicknesses of the sidewall portions 480 associated with each of the second pleat portions 462 in the reversible baffle 100 serve to prevent each of the pleats 450 from becoming such a bi-stable structure. That is, rather than the respective pleats 450 of the reversible baffle 100 having both a normal (e.g., closed) position in which the respective pleat extends relatively radially inwardly toward the central axis 118 and also a second stable position in which the respective pleat is substantially fixed or wedged into a distended position, the different sidewall portion thicknesses of each of the pleats 450 result in the respective pleats each having only a single stable position—namely, the normal (e.g., closed) position of each pleat shown in FIGS. 2, 3, 4, 5, 8, 9, 10, and 11. Accordingly, in the present embodiment of the reversible baffle 100, the likelihood that one or more of the pleats 450 will become jammed in a distended position, such as a position where the respective pleat droops or sags well below the mid-plane 850 of the reversible baffle, is much reduced. To the contrary, the pleats 450 have a strong tendency to return to their normal positions illustrated in FIGS. 2, 3, 4, 5, 8, 9, 10, and 11 when not forcibly moved in another direction.

Although all of the above-described features shown in FIGS. 1 through 14 are included in the present embodiment of the reversible baffle 100, it should be appreciated that the present disclosure is also intended to encompass numerous other embodiments of reversible baffles that lack one or more (or all) of these features, and/or that include one or more other features in addition to or instead of one, more, or all of these features included by the reversible baffle 100. Among other things, notwithstanding the above description, it should be appreciated that one or more of the features described above in regard to the reversible baffle 100 can be modified in any of a number of manners to achieve other reversible baffles encompassed by the present disclosure that can achieve one or more of the functional objectives described above. For example, in one example embodiment of a reversible baffle also encompassed herein, the reversible baffle would include more than four of the water flow holes 490, but otherwise include all of the other features described above.

Figure 15:
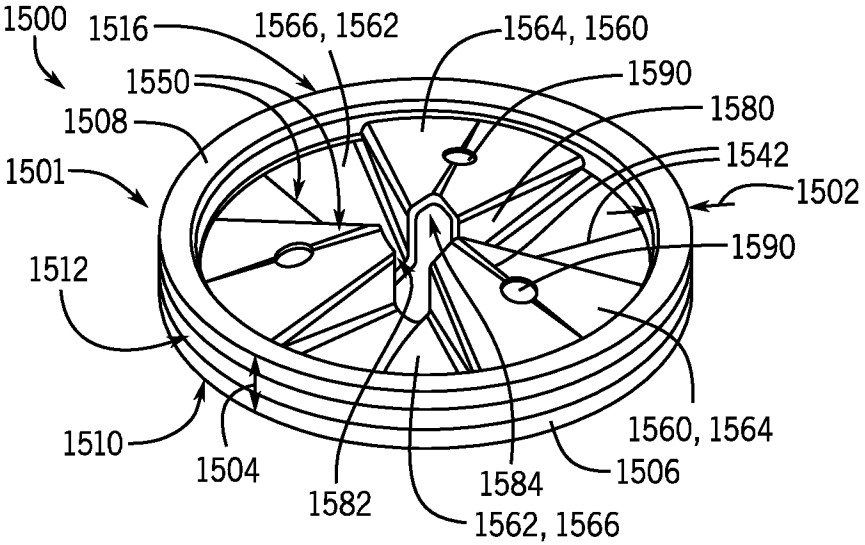
FIG. 15 is a perspective view of a first example alternate embodiment of an improved reversible baffle that also can be implemented, in either of two orientations, as part of an improved food waste disposer system mounted in relation to a sink, such as that shown in FIG. 1, instead of the reversible baffle of FIGS. 1 through 14.

Further for example, referring to FIG. 15, a perspective view is provided of a first alternate embodiment of a reversible baffle 1500 that, like the reversible baffle 100, is an asymmetric baffle that is intended to achieve sound reducing operation when orientated within one position within a sink flange (such as the sink flange 112) and to achieve high water flow operational position in a second orientation within the sink flange. More particularly, based upon a comparison of FIG. 15 with FIG. 4, it can be appreciated that the reversible baffle 1500 is similar to the reversible baffle 100 in that, among other things, the reversible baffle 1500 includes a cylindrical rim 1501 having a radial extent 1502 and an axial extent 1504, and further comprising an outer cylindrical surface 1506 that extends between a first annular edge 1508 and a second annular edge 1510 along with an annular groove 1512 within the outer cylindrical surface between the first and second annular edges. Thus, in the embodiment of FIG. 15, the cylindrical rim 1501 of the reversible baffle 1500 is identical or substantially identical to the cylindrical rim 401 of FIG. 4.

The reversible baffle 1500 also has multiple pleats 1550 that resemble in several respects the pleats 450 of the reversible baffle 100. In particular, it can be seen that the pleats 1550 include first pleat portions 1560 and second pleat portions 1562. Also, the reversible baffle 1500 includes sidewall portions 1580 that are positioned in between adjacent ones of the first pleat portions 1560 and the second pleat portions 1562. Further, it should be appreciated that a first face 1516 of the reversible baffle 1500 is formed at least in part by first surface portions 1564 of the first pleat portions 1560 and second surface portions 1566 of the second pleat portions 1562, and that the first and second surface portions 1564 and 1566 respectively correspond to the first and second surface portions 464 and 466 of FIG. 4. Although not shown, it should be appreciated that the reversible baffle 1500 also includes a second face opposite the first face 1516 that is made up at least partly by way of surface portions along the first and second pleats portions 1560 and 1562 that correspond to the third and fourth surface portions 468 and 470 described with respect to FIG. 5.

Also similar to the reversible baffle 100, the first surface portions 1564 of the first pleat portions 1560 are closer to the first annular edge 1508 than to the second annular edge 1510 and that the second pleat portions 1562 (including the second surface portions 1566 thereof) are closer to the second annular edge 1510 than to the first annular edge 1508. Additionally, the reversible baffle 1500 includes water flow holes 1590 that correspond to the water flow holes 490 of FIG. 4. Similar to the water flow holes 490, the water flow holes 1590 are respectively positioned within the respective first pleat portions 1560, generally within the interiors of the respective first pleat portions midway along the respective radial extents of those respective first pleat portions and generally between respective sidewall portions 1580 extending on both sides of the respective first pleat portions, along respective middle ridges 1542 of the respective first pleat portions.

Notwithstanding the above-discussed similarities between the reversible baffle 1500 of FIG. 15 and the reversible baffle 100 of FIG. 4 (among others), it should also be evident from a comparison of FIG. 15 with FIG. 4 that there are differences between the two reversible baffles 1500 and 100 as well. To begin, although the reversible baffle 100 has four of the pleats 450 and correspondingly has four of each of the first pleat portions 460 and second pleat portions 462 (and eight of the sidewall portions 480), the reversible baffle 1500 has three of the pleats 1550 and correspondingly has three of each of the first pleat portions 1560 and second pleat portions 1562 (and six of the sidewall portions 1580). Additionally, although as shown in FIG. 6 and FIG. 7, the angular extent of each of the second pleat portions 462 is only about two-thirds that of the angular extent of each of the first pleat portions 460 (e.g., 36 degrees rather than 54 degrees), FIG. 15 shows that the second pleat portions 1562 share in common with one another an angular extent that is closer in size to, albeit still smaller than, the angular extent of each of the first pleat portions 1560.

Notwithstanding such differences, it should be understood that the particular embodiment of the reversible baffle 1500 of FIG. 15 is intended to provide or achieve, in a manner similar to that of the reversible baffle 100, both sound reducing operation and high water flow operation depending upon the orientation of the reversible baffle when implemented within a baffle-less food waste disposer system such as the baffle-less food waste disposer system 116. In particular, the reversible baffle 1500, despite having three of the pleats 1550 rather than four of the pleats 450, nevertheless has features that correspond to each of the features described in regard to the reversible baffle 100 that are intended to allow for that reversible baffle to be operated in each of the sound reducing mode and the high water mode. Indeed, the reversible baffle 1500 not only includes the first pleat portions 1560 that are larger in angular extent than the second pleat portions 1562 and therefore includes valleys corresponding to the first pleat portions 1560 that are larger than the valleys corresponding to the second pleat portions, but also the reversible baffle 1500 has narrow width openings 1582 at the tips of the second pleat portions (corresponding to the narrow width openings 800) that are narrower than the openings 1584 at the tips of the first pleat portions (corresponding to the openings 900).

Also, the tips of second pleat portions 1562 extend farther from a mid-plane of the reversible baffle 1500 than the tips of the first pleat portions 1560, and the inner diameter of the cylindrical rim 1501 forming the outer diameter of the second pleat portions 1562 is larger than the inner diameter of the cylindrical rim forming the outer diameter of the first pleat portions 1560. Additionally, the water flow holes 1590 are formed on the first pleat portions 1560, but not the second pleat portions 1562, and the reversible baffle 1500 includes a central orifice 1586 that again is drafted (e.g., given the shapes of the tips of the pleats 1550).

Accordingly, it is intended that, if the reversible baffle 1500 is implemented within the baffle-less food waste disposer system 116 with the first face 1516 facing vertically upward, the combination of those structures will be an improved food waste disposer system that is configured for sound reducing operation. Inversely, it is also intended that, if the reversible baffle 1500 is implemented within the baffle-less food waste disposer system 116, with the first face 1516 facing vertically downward, the combination of those structures will be an improved food waste disposer system that is configured for high water flow operation.

Figure 16:
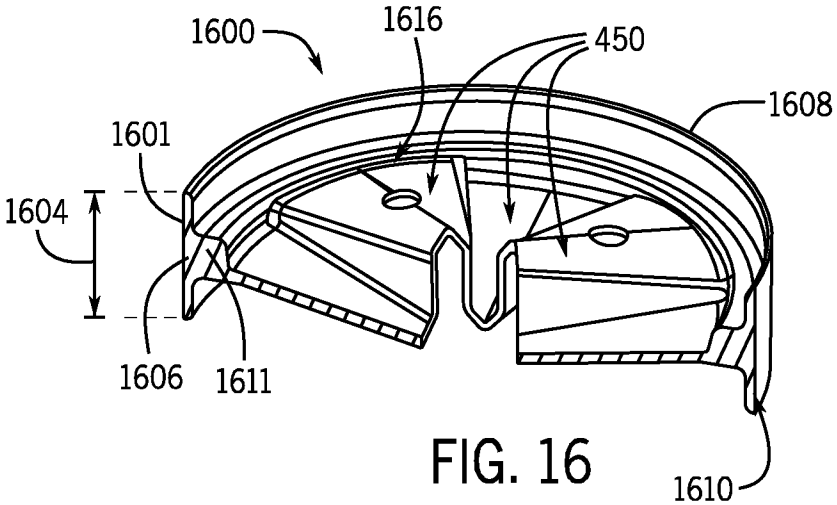
FIG. 16 is a perspective, cross-sectional view of a second example alternate embodiment of an improved reversible baffle that also can be implemented, in either of two orientations, as part of an improved food waste disposer system mounted in relation to a sink, such as that shown in FIG. 1, instead of the reversible baffles of FIGS. 1 through 15.

Turning to FIG. 16, a perspective cross-sectional view is provided of a second alternate embodiment of a reversible baffle 1600, in accordance with an additional embodiment encompassed herein. FIG. 16 shows a cross-section of the reversible baffle 1600 that is taken along a line that is substantially the same as that used to generate the view of the reversible baffle 100 shown in FIG. 2 and, as is evident from a comparison of FIG. 16 with FIG. 4, the reversible baffle 1600 has the same pleats (namely, the pleats 450) that are present in the reversible baffle 100. However, a cylindrical rim 1601 of the reversible baffle 1600 differs from the cylindrical rim 401 in several respects. In particular, the cylindrical rim 1601 has an outer cylindrical surface 1606 that does not have any annular groove that would correspond to the annular groove 412 of the reversible baffle 100. Also, the cylindrical rim 1601 has an axial extent 1604 that is greater than the axial extent 404 of the cylindrical rim 401 and thus has first and second annular edges 1608 and 1610 that are respectively farther apart from one another than the annular edges 408 and 410. Notwithstanding the differences between the axially outermost portions of the cylindrical rim 1601 and the cylindrical rim 401, it should also be recognized that an annular inner portion 1611 of the cylindrical rim 1601 (which interfaces the pleats 450) has substantially the same dimensions as corresponding portions of the cylindrical rim 401.

Given the similarities between the reversible baffle 1600 of FIG. 16 and the reversible baffle 100 of FIG. 4, it should be appreciated that the reversible baffle 1600 again is intended to achieve each of sound reducing performance and high water flow operation depending upon its implementation. Accordingly, it is intended that, if the reversible baffle 1600 is implemented within a baffle-less food waste disposer system such as the baffle-less food waste disposer system 116 with a first face 1616 of the reversible baffle facing vertically upward, the combination of those structures will be an improved food waste disposer system that is configured for sound reducing operation. Inversely, it is also intended that, if the reversible baffle 1600 is implemented within the baffle-less food waste disposer system 116, with the first face 1616 facing vertically downward, the combination of those structures will be an improved food waste disposer system that is configured for high water flow operation. However, in contrast to the reversible baffle 100 of FIG. 4, the reversible baffle 1600 would not be positioned and retained within a sink flange by way of any interplay between an annular rim of the sink flange and complementary annular groove of the reversible baffle, but rather would be positioned and held in place relative to a sink flange in another manner. For example, in some such embodiments, the sink flange can have an annular radially-inwardly extending rib upon which either of the first or second annular edges 1608 and 1610 of the baffle 1600 can rest, depending upon the orientation of the reversible baffle.

Figure 17:
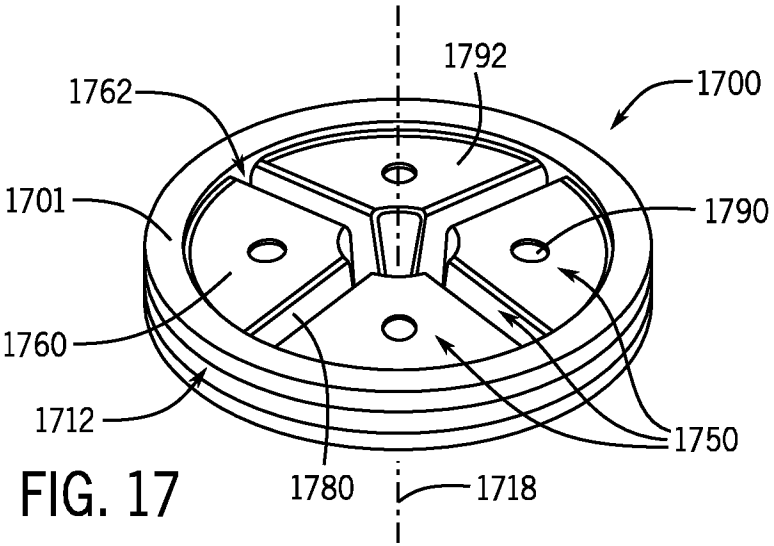
FIG. 17 is a perspective view of a third example alternate embodiment of an improved reversible baffle that also can be implemented, in either of two orientations, as part of an improved food waste disposer system mounted in relation to a sink, such as that shown in FIG. 1, instead of the reversible baffles of FIGS. 1 through 16.

Turning next to FIG. 17, a perspective view is additionally provided to show a third alternate embodiment of a reversible baffle 1700. In this embodiment, the reversible baffle 1700 again includes a cylindrical rim 1701 having characteristics that are identical or substantially similar to those of the cylindrical rims 401 and 1501, including an annular groove 1712 corresponding to the annular grooves 412 and 1512. Also, in this example embodiment, the reversible baffle 1700 includes multiple pleats 1750 that include first pleat portions 1760, second pleat portions 1762, and sidewall portions 1780 extending therebetween. Further as shown, each of the first pleat portions 1760 includes a respective water flow hole 1790 extending therethrough, with the water flow holes 1790 serving substantially the same purpose as the water flow holes 490 described above.

Notwithstanding the above discussion, the pleats 1750 of the reversible baffle 1700 differ in certain respects from the pleats 450 of the reversible baffle 100. Although the pleats 1750 include the first pleat portions 1760 and the second pleat portions 1762 that are analogous to the first pleat portions 460 and second pleat portions 462 of the pleats 450, the respective first pleat portions 1760 are substantially larger in terms of their respective angular extents relative to the respective angular extents of the respective second pleat portions 1762, and also the second pleat portions 1762 no longer (in contrast to the second pleat portions 462) take the form of portions of wedges or sectors. Correspondingly, while the pleats 1750 include the sidewall portions 1780, the sidewall portions do not respectively extend outward in a radial manner from a central axis 1718 of the reversible baffle 1700. Rather, with respect to each of the pairs of the sidewall portions 1780 on the sides of each of the second pleat portions 1762, each of the two sidewall portions extends generally outward away from the central axis 1718 in a manner where each of the two sidewall portions is parallel to (but shifted relative to) a respective line that extends radially outward from the central axis 1718 through the middle of the respective second pleat portion. Thus, in this embodiment, the second pleat portions 1762, in addition to being of a smaller angular extent than the first pleat portions 1760, also each have a width that is constant, or substantially constant, as one proceeds along the second pleat portions 1762 away from the central axis 1718 to the cylindrical rim 1701.

Given the similarities between the reversible baffle 1700 of FIG. 17 and the reversible baffle 100 of FIG. 4, it should be appreciated that the reversible baffle 1700 again is intended to achieve each of sound reducing performance and high water flow operation depending upon its implementation. Accordingly, it is intended that, if the reversible baffle 1700 is implemented within a baffle-less food waste disposer system, such as the baffle-less food waste disposer system 116, with a first face 1792 of the reversible baffle facing vertically upward, the combination of those structures will be an improved food waste disposer system that is configured for sound reducing operation. Inversely, it is also intended that, if the reversible baffle 1700 is implemented within the baffle-less food waste disposer system 116, with the first face 1792 facing vertically downward, the combination of those structures will be an improved food waste disposer system that is configured for high water flow operation.

It should be appreciated that each of the embodiments described above in relation to FIGS. 1 through 17 involves a respective baffle that is reversible in the sense that the respective baffle can be implemented within a baffle-less food waste disposer system (and particularly a sink flange thereof) in either of two oppositely-directed orientations. Also, each of these above-described embodiments of reversible baffles is asymmetric, in that the features or characteristics of the respective baffle that affects, or substantially affects, water flow along and through the respective baffle are different depending upon the orientation of the baffle, such that depending upon the orientation of the respective baffle different functional objectives are achieved (or achieved to substantially different degrees). Notwithstanding this to be the case, the present disclosure is also intended to encompass other embodiments of reversible baffles in which the baffle features are symmetric or effectively symmetric about a mid-plane of the baffle. By virtue of such symmetry, the features or characteristics of the respective baffle that affect or substantially affect water flow along and through the baffle are the same, or substantially the same, irrespective of the orientation of the baffle and, at least during normal operation of the baffle, the same, or substantially the same, functional objectives are achieved (or achieved to substantially the same degree) irrespective of the orientation of the baffle.

Figure 18:
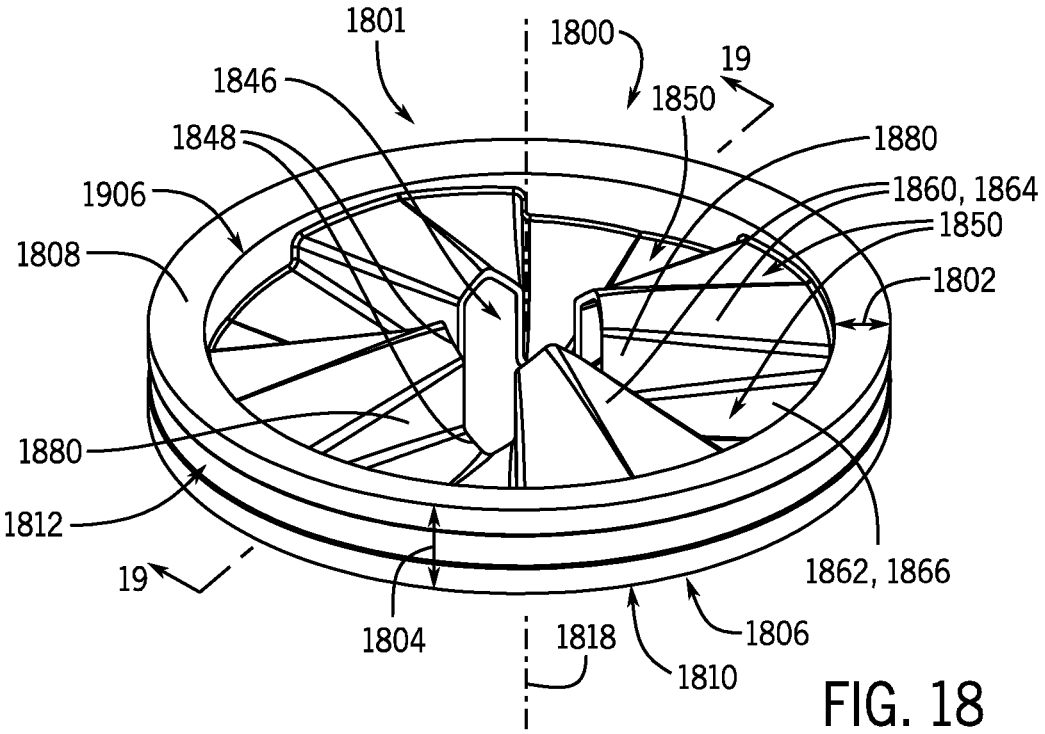
FIG. 18 is a perspective view of a fourth example alternate embodiment of an improved reversible baffle that also can be implemented, in either of two orientations, as part of an improved food waste disposer system mounted in relation to a sink, such as that shown in FIG. 1, instead of the reversible baffles of FIGS. 1 through 17.
Figure 19:
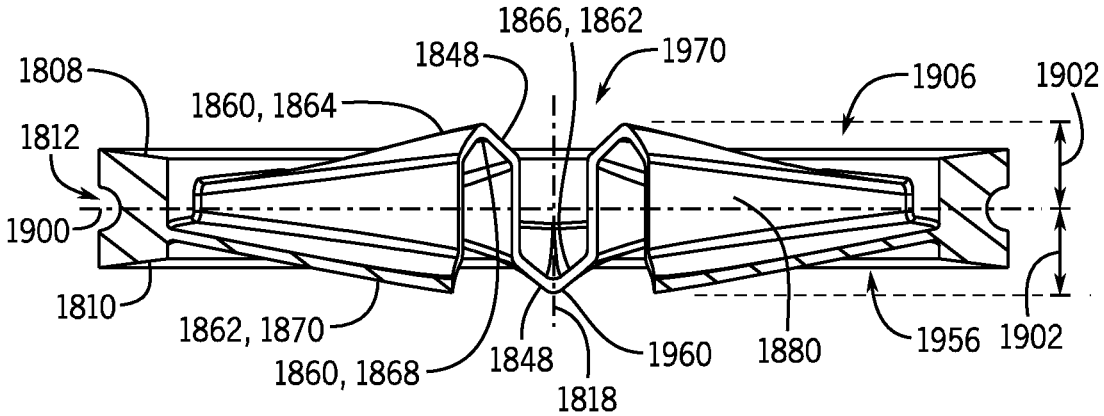
FIG. 19 is a cross-sectional view of the reversible baffle of FIG. 18, taken along line 19-19 of FIG. 18.

Turning to FIG. 18 and FIG. 19, a perspective view and a cross-sectional view taken along a line 19-19 of FIG. 18, respectively, of an example symmetric reversible baffle 1800 are provided. It should be appreciated from FIG. 18 that the reversible baffle 1800 has features that in many respects resemble those of the other baffles described herein, including the reversible baffle 100. As shown, the reversible baffle 1800 includes a cylindrical rim 1801 having a radial extent 1802 and an axial extent 1804 as measured in relation to a central axis 1818. The cylindrical rim 1801 additionally includes an outer cylindrical surface 1806 that extends between a first annular edge 1808 and a second annular edge 1810. As with the reversible baffle 100, the reversible baffle 1800 also includes an annular groove 1812 positioned along the outer cylindrical surface 1806 situated between, or substantially between, the first and second annular edges 1808 and 1810. Again, the annular groove 1812 is intended to interface an annular rib on the inner surface of the sink flange so as to allow the reversible baffle 1800 to be supported within the sink flange. Also, as with the reversible baffle 100 (as well as the baffles 1500, 1600, and 1700), the reversible baffle 1800 can be made of a rubber material such as nitrile rubber.

In addition, the reversible baffle 1800 also includes multiple pleats 1850 that in the present example embodiment include four first pleat portions 1860 and four second pleat portions 1862. As illustrated, the first pleat portions 1860 are positioned generally closer to the first annular edge 1808 relative to the central axis 1818 than the second pleat portions 1862, and vice-versa. Also, the pleats 1850 include multiple sidewall portions 1880 that extend radially inwardly from the cylindrical rim 1801 towards the central axis 1818, up to a central orifice 1846 that surrounds the central axis 1818 and is formed by tips 1848 of the pleats 1850. It should be appreciated from FIG. 18 that the first pleat portions 1860 include first surface portions 1864 and that the second pleat portions include second surface portions 1866. A first face 1906 of the reversible baffle 1800 is substantially formed by the combination of the first annular edge 1808, the first and second surface portions 1864 and 1866, and surface portions of the sidewall portions 1880 linking those first and second surface portions. Also, as particularly shown in FIG. 19, the first pleat portions 1860 have respective third surface portions 1868 and the second pleat portions 1862 have respective fourth surface portions 1870 that, together with the second annular edge 1810 and surfaces of the sidewall portions 1880 linking those third and fourth surface portions, form a second face 1956 that is oppositely-directed relative to the first face 1906.

Of particular significance in the reversible baffle 1800, shown in FIG. 18 and FIG. 19, is that the reversible baffle exhibits certain physically symmetric features. In this regard, it should first be appreciated that the first pleat portions 1860 have the same angular extent as the second pleat portions 1862, and further that the tips 1848 of the first pleat portions 1860 are located at the same radial positions relative to the central axis 1818 as the tips of the second pleat portions 1862. More generally, it should further be appreciated that the reversible baffle 1800 is symmetric about any diameter extending through the baffle and through the central axis 1818 that is positioned so as to extend through the respective center of any of the first pleat portions 1860 or any of the second pleat portions 1862 (e.g., the respective center of the respective pleat portion between the two sidewall portions adjacent to the respective pleat portion) including, for example, the diameter represented by the line 19-19.

In addition to being symmetric about diameters through the reversible baffle 1800, as described above, the reversible baffle 1800 is also effectively symmetric about a mid-plane 1900 of the reversible baffle. More particularly, it will be appreciated from FIG. 18 and FIG. 19 that the reversible baffle 1800 is not exactly symmetric with respect to the mid-plane 1900, given that the first pleat portions 1860 alternate with the second pleat portions 1862 as one proceeds circumferentially around the reversible baffle (about the central axis 1818). For example, as shown in FIG. 19, given the positioning of a first one 1960 of the first pleat portions 1860, there is no corresponding pleat portion at a location 1970 on the opposite side of the mid-plane 1900, but rather merely a space at that location. Nevertheless, if one rotates the structure of the reversible baffle 1800 associated with one-half of the baffle above or below the mid-plane 1900 by an angle of 45 (forty-five) degrees, which is approximately the angular extent of each of the first pleat portions 1860 and each of the second pleat portions 1862 (as measured between the respective sidewall portions 1880 on opposite sides of each respective one of the pleat portions), the two halves of the baffles are symmetric with one another.

In particular, the structure of each of the first pleat portions 1860 is a mirror image of the structure of the second pleat portions 1862 (assuming a mirror image if one rotates one-half of the reversible baffle 1800 as mentioned above). Not only does each of the first pleat portions 1860 have an angular extent that is identical to that of each of the second pleat portions 1862, but also a maximum axial extent 1902 of each of the first pleat portions 1860 away from the mid-plane 1900 at the tips 1848 thereof, is identical to the maximum axial extent of each of the second pleat portions 1862, again at the tips thereof, away from the mid-plane in the opposite direction (which is also shown in FIG. 19 to be the maximum axial extent 1902). In addition to these features, it should also be noted that, in the present embodiment, the annular groove 1812 is positioned exactly between the annular edges 1808 and 1810 and therefore also is symmetric about the mid-plane 1900.

Given this to be the case, the reversible baffle 1800 is effectively symmetric about the mid-plane 1900 in terms of the effect or influence of the reversible baffle upon water flowing on and through the reversible baffle. Because of the symmetric positioning of the annular groove 1812, the reversible baffle 1800 will be positioned at the same vertical level within a sink flange, such as the sink flange 112 (e.g., along the central axis 1818) regardless of whether the first face 1906 or the second face 1956 is facing vertically upward. Further, water passing through the sink flange and onto the reversible baffle 1800 will encounter, depending upon the orientation of the reversible baffle, structural features of either the first face 1906 or the second face 1956 that are identical, or substantially identical, except for the slight rotational change of those features about the central axis 1818. Because typically the exact rotational orientation of the structural features of the reversible baffle 1800 about the central axis 1818 will have no impact upon performance of the reversible baffle, the reversible baffle can be said to be effectively symmetric.

Because of such effective symmetry of the reversible baffle 1800, the reversible baffle cannot achieve different/alternative functional objectives depending upon its orientation, as was the case with the asymmetric reversible baffles (e.g., the reversible baffles 100, 1500, 1600, and 1700) described above. Nevertheless, the effective symmetry of the reversible baffle 1800 does permit a further functional objective to be achieved. In particular, because the reversible baffle 1800 can be flipped or inverted and still achieve the same (or substantially the same) performance, if any one or more of the pleats 1850 should happen to experience sagging, the reversible baffle can be removed from the sink flange within which it is positioned, inverted, and positioned back into the sink flange so as to rectify (or substantially rectify) the sagging. Due to the force of gravity, even if one or more of the pleats 1850 experiences sagging when the reversible baffle is in one orientation, the inverting of the reversible baffle will tend to compensate for any weakness in the material of the reversible baffle and thereby typically will result (at least for a period of time) in a restored reversible baffle in which sagging is no longer occurring. That is, through use of such a symmetric, reversible baffle, if any pleats begin to sag as time goes by (or even prior to such sagging occurring), the baffle can be reoriented in an inverted manner such that the pleats tend not to be sagging in the same direction and gravity tends to counteract any deformation in the pleat structure that may have already developed. Accordingly, a symmetric, reversible baffle as illustrated by the reversible baffle 1800 can be of particular value insofar as the reversible baffle can be inverted by a user as time goes by, during the life of the baffle, so as to extend the life of the reversible baffle.

As mentioned above, the present disclosure is intended to encompass numerous different embodiments of reversible baffles, including numerous different embodiments of asymmetric reversible baffles, as well as numerous different embodiments of symmetric reversible baffles, in addition to those described above. For example, in regard to symmetric reversible baffles, it should be appreciated that in some alternate embodiments also encompassed herein that the symmetric reversible baffles can have three pleats rather than four pleats, in a manner similar to that shown in FIG. 15 in regard to the asymmetric reversible baffle 1500. Also, other alternate embodiments of symmetric reversible baffles can have cylindrical rims that are differently shaped than that shown in FIG. 18 including, for example, cylindrical rims lacking an annular groove, such as that shown in FIG. 16. Also, notwithstanding the above discussion of reversible baffles having four or three pleats, the present disclosure is also intended to encompass alternate embodiments of reversible baffles in which there are less than three (e.g., two) or more than four (e.g., six or eight) pleats.

Additionally, although in the embodiments of baffles shown and discussed above, each of the sidewall portions (e.g., the sidewall portions 480 of the baffle 100) has a straight or substantially straight contour as one proceeds radially outward from the central orifice toward the cylindrical rim of the baffle, this need not be the case in all embodiments. For example, in some alternate embodiments of baffles encompassed herein, the baffles can have one or more sidewall portions that are curved as one proceeds radially outward from the central orifice of the baffle toward the cylindrical rim of the baffle. Further for example, one such alternate embodiment would be a modified version of the baffle 100 having modified sidewall portions differing from the sidewall portions 480 insofar as each of the sidewall portions would be shaped in a convex or concave manner. In such an embodiment, the second pleat portions (e.g., the pleat portions corresponding to the second pleat portions 462) as bounded by the modified sidewall portions would bulge slightly outward midway between the central orifice and the cylindrical rim, relative to their appearance in FIG. 7. Conversely, in such an embodiment, the first pleat portions (e.g., the pleat portions corresponding to the first pleat portions 460) as bounded by the modified sidewall portions would be somewhat narrowed midway between the central orifice and the cylindrical rim, relative to their appearance in FIG. 6. Such modifications to the shaping of the sidewall portions can, depending upon the embodiment, enhance operation of the baffle in the sound reducing mode and/or the high water flow mode.

Further, in other alternate embodiments encompassed herein, the reversible baffles can have different water flow hole arrangements than those discussed above. For example, in some alternate embodiments, there can be more than one water flow hole arranged on a given pleat. Also for example, although the symmetric reversible baffle 1800 of FIG. 18 and FIG. 19 does not include any water flow holes, other embodiments of symmetric reversible baffles encompassed herein can have one or more water flow holes (in addition to the central orifice of the baffle). Additionally for example, in some alternate embodiments one or more of the water flow holes can have annular lips defining the water flow holes that have distinctive shapes that affect water flow through the holes. In one such alternate embodiment, further for example, a modified version of the baffle 100 would have modified versions of the water flow holes 490 in which, for each hole, an annular lip defining the respective water flow hole would include both an annular rib that extends slightly above the surface of the pleat portion in which the water flow hole is formed along one side of the pleat portion, and also would include an annular depression (or fillet) that extends slightly below the surface of the pleat portion in which the water flow hole is formed along the other side of the pleat portion.

More particularly, in such an embodiment, the annular lips defining the water flow holes would include annular ribs extending slightly above the first surface portions 464 of the first pleat portions 460 such that, when the baffle was positioned in the manner shown in FIG. 10, water sitting atop the first surface portions would be further restricted from entering and passing through the water flow holes due to the annular ribs. This would tend to further contribute to operation of the baffle in the sound reducing mode. Also in such an embodiment, the annular lips defining the water flow holes would include annular depressions extending slightly below the third surface portions 468 of the first pleat portions 460 such that, when the baffle was positioned in the manner shown in FIG. 11, water sitting within the second valleys 474 atop the third surface portions would more easily enter and pass through the water flow holes due to the annular depressions sloping (or ramping) downward into the water flow holes. This would tend to further contribute to operation of the baffle in the high water flow mode. Notwithstanding this particular example of an alternate embodiment, in other alternate embodiments encompassed herein the annular lips defining the water flow holes can take other forms as well, including forms in which the annular lip of one water flow hole of a baffle differs in its characteristics from those of one or more other annular lips of one or more other water flow holes of the baffle.

Further for example, although it is envisioned that the reversible baffles described above will typically be made out of a flexible rubber material such as nitrile rubber, the present disclosure is also intended to encompass reversible baffles made from other materials, including other flexible materials such as TPE. Also, although it is envisioned that each of the reversible baffles described above is integrally formed as a single or unitary structure from a single material, the present disclosure is also intended to encompass alternate embodiments of reversible baffles that are made from multiple component parts, and/or from multiple materials. For example, in some alternate embodiments the pleats can be made from a different material or materials than the cylindrical rim.

Also, although in the above discussion the reversible baffles are intended for implementation within baffle-less food waste disposer systems so as to form improved food waste disposer systems, the present disclosure is additionally intended to encompass reversible baffles that are implemented (or capable of being implemented) within other types of waste disposer systems or other types of disposer systems, rather than merely food waste disposer systems. Correspondingly, the present disclosure is intended to encompass a variety of waste disposer system or other disposer systems, in addition to (or instead of) food waste disposer systems. Further, the term baffle-less food waste disposer system is used for convenience herein to refer to a structure into which one or more of the reversible baffles encompassed herein can be implemented so as to arrive at the combination of an improved food waste disposer system that includes the reversible baffle. Nevertheless, it should be appreciated that the present disclosure is also intended to encompass embodiments in which one or more reversible baffles encompassed herein is or are implemented within a disposer system that already includes one or more other baffle(s). That is, the term baffle-less waste disposer system should be generally understood to encompass any disposer system, regardless of whether one or more structures that are or can be considered to be baffle(s) is or are already implemented within that disposer system, in relation to which one or more of the reversible baffle(s) described herein can additionally be implemented to arrive at an overall combination disposer system that includes one or more reversible baffle(s).

Also, the present disclosure is intended to encompass numerous methods (or processes) according to which baffles are implemented or operated within disposer systems such as food waste disposer systems, as well as methods (or processes) for implementing or operating disposer systems such as food waste disposer systems. For example, in view of the above description, it should be appreciated that the present disclosure among other things encompasses a method of implementing a baffle in relation to a sink flange of the disposer system, where the method involves making a determination (e.g., having a user make a determination) regarding whether the disposer system should be configured to operate in accordance with a first operational mode to achieve a first functional objective (e.g., sound reduced operation), or in accordance with a second operational mode to achieve a second functional objective (e.g., high water flow operation). After the determination is made, the method additionally includes inserting the baffle into a sink flange of the disposer system, and receiving a protrusion extending radially-inwardly from an inner surface of the sink flange into a complementary receiving formation provided within an outer surface of the cylindrical rim (e.g., an annular groove within an outer cylindrical surface of the cylindrical rim) so that the baffle is supported in relation to the sink flange, where the complementary receiving formation is configured so as to permit the baffle to be supported in relation to the sink flange regardless of whether the baffle has the first orientation or the second orientation. In such method, the baffle particularly is inserted into and supported in relation to the sink flange so that the baffle has the first orientation or so that the baffle has the second orientation in accordance with the determination.

Also for example, the present disclosure among other things encompasses a method of operating the baffle after it has been implemented as described above (e.g., after being inserted into and supported in relation to the sink flange). Such method of operating can include receiving water or other material atop a vertically upward-facing or substantially vertically upward-facing face of the baffle, communicating the water or other material within valleys formed with the face, and passing the water or other material to a to a location beneath the baffle by way of the central orifice or one or more flow holes of the baffle. Additionally, at some point it can be determined that it is desirable for the baffle to be reoriented so as to achieve a different functional objective. For example, if the baffle was initially inserted so as to have the first orientation such that the disposer system would operate to achieve the first functional objective, it may become desirable that the baffle be reoriented so as to have the second orientation such that the disposer system would operate to achieve the second functional objective (or vice-versa). Accordingly, in at least some embodiments encompassed herein, the method of operation can include removing the baffle, and reinserting the baffle and supporting the baffle in relation to the sink flange, such that the baffle has the second orientation if it initially was inserted so as to have the first orientation, or vice-versa. The method can then continue with receiving additional water or other material atop an additional face of the baffle (which is oppositely-directed relative to the earlier-recited vertically upward-facing or substantially vertically upward-facing face), communicating the additional water or other material within additional valleys formed in the additional face, and passing the additional water or other material to the location beneath the baffle by way of the central orifice or one or more flow holes of the baffle.

Further, another example embodiment encompassed herein relates to a method of operating a disposer system, where the disposer system includes a sink flange and a baffle having a plurality of pleats. The method includes determining that at least one of the pleats, or at least one portion of the pleats, is experiencing sagging or is likely to experience sagging in the near future, when the baffle has a first orientation within the sink flange. The method also includes removing the baffle from the sink flange, and inserting the baffle into the sink flange of the disposer system so that the baffle has a second orientation that is substantially inverted relative to the first orientation, where the inserting of the baffle so that the baffle has the second orientation substantially or entirely alleviates or avoids, for at least a first time period, the sagging.

In at least some cases, such a method of operating the disposer system additionally includes, prior to the determining, providing the baffle into the sink flange of the disposer system so that the baffle has the first orientation, receiving first water or other material atop a first face of the baffle that is vertically upward-facing or substantially vertically upward-facing within the disposer system, and first passing the first water or other material to a grinding chamber within the disposer system beneath the baffle by way of a central orifice of the baffle. Also, in at least some cases, such a method of operating the disposer system further includes, after the inserting, receiving second water or other material atop a second face of the baffle that is vertically upward-facing or substantially vertically upward-facing within the disposer system, where the second face is substantially oppositely-directed to the first face, and passing the second water or other material to the grinding chamber beneath the baffle by way of the central orifice of the baffle. Because of effective symmetry between the first and second faces, the second passing of the second water or other material occurs in substantially the same manner as the first passing of the first water or other material. Further in at least some cases, each of the inserting and providing of the baffle into the sink flange includes receiving a protrusion extending radially-inwardly from the inner surface of the sink flange into a complementary receiving formation provided within an outer surface of the cylindrical rim so that the baffle is supported in relation to the sink flange. The complementary receiving formation is an annular groove extending around the outer surface of the cylindrical rim and is substantially aligned with a mid-plane of the baffle that is perpendicular to a central axis of the baffle, and the annular groove is configured so as to permit the baffle to be supported in relation to the sink flange regardless of whether the baffle has the first orientation or the second orientation.

Additionally, although one or more of the reversible baffles (or disposer systems or related methods involving reversible baffles) shown herein are described as having one or more features that provide one more particular functional advantages, it should be understood that the present disclosure is intended to encompass numerous other embodiments of reversible baffles, in which one or more of such features are omitted, replaced, or supplemented by one or more other features, and in which one or more of the aforementioned functional advantages are not achieved at all, or to the same degree, or are replaced or supplemented by other functional advantages. Further for example, although not discussed above in regard to the symmetric reversible baffle 1800 of FIG. 18, in some alternate embodiments encompassed herein a symmetric reversible baffle can include sidewall portions associated with (on opposite sides of) each respective pleat portion that are of relatively different thicknesses in the manner described above in regard to FIG. 14 with respect to the asymmetric reversible baffle 100, so as to achieve a symmetric reversible baffle that avoids or reduces the likelihood that pleats of the baffle will be bi-stable as described above.

In view of the above discussion, it should be appreciated that reversible baffles as encompassed herein can achieve any one or more of numerous functional objectives or advantages depending upon the embodiment. For example, in some embodiments encompassed herein, the reversible baffle has structural features that are asymmetric (e.g., relative to a mid-plane of the baffle) such that the reversible baffle can be implemented in either of two orientations within a baffle-less food waste disposer system, so as to achieve an improved food waste disposer system that has either of two configurations. In some such embodiments, the features of such an asymmetric reversible baffle are designed so that, depending upon the orientation of the reversible baffle within the improved food waste disposer system, the improved food waste disposer system can be configured to operate either in a sound reducing mode or a high water flow mode. Given such configurability of the improved food waste disposer system, users are provided with an ability to adjust the installation of the reversible baffle to suit their particular installations or circumstances.

For example, some users may be inclined to implement the reversible baffle in one orientation so as to achieve sound reduced operation because, for example, the food waste disposer systems may be intended for use with water efficient faucets where water backups are not a concern, may be employed to grind harder food waste that tends to generate more noise. Conversely, also for example, some users may be inclined to implement the reversible baffle in the other orientation, so as to achieve high water flow operation because, for example, the food waste disposer systems may be intended for use with high water flow faucets, there may be concerns that the food waste disposer systems may be provided with certain types of food that is more likely to get stuck passing through the baffle, or the food waste disposer systems may be operated in conjunction with plumbing arrangements that hinder the air in the grind chamber from escaping through the plumbing.

As discussed above, depending upon the embodiment, such asymmetric reversible baffles can entail one or more features that allow the baffle to provide or foster each of sound reducing operation and high water flow operation, depending upon its orientation, and/or that tend to result in changes to the water flow rates through the baffle, depending upon its orientation. Such features permitting such dual modes of operation can include, for example, the provision of water flow (or drain) holes (such as the holes 490 and 1590 discussed above) that are particularly located within the pleat portions over which the water tends to flow when the reversible baffle is orientated for high water flow operation—but not within, or not primarily within, the pleat portions over which water tends to flow when the reversible baffle is orientated for sound reducing operation. With water flow holes of this type, when the reversible baffle is positioned for high water flow operation, the water flow holes allow both for water to pass through the reversible baffle and into the grind chamber of the food waste disposer system, as well as allow air in the grind chamber to escape. Permitting air to escape can be desirable because, if the air is unable to vacate the grind chamber as quickly as the water is entering the grind chamber, then the water flow can be impeded. By contrast, when the reversible baffle is positioned for sound reducing orientation, the drain holes are located on the top of the pleats. This forces the water to pool more on top of the pleats before covering and migrating through the holes (again, in the high water flow orientation the water flow holes are located on the bottom of the pleats, and consequently the water will pool less before it covers and passes through the holes).

Such features permitting such dual modes of operation also can involve one or more structural aspects of the pleats, or the geometry of the pleats. For example, in at least some embodiments, the pleats are configured so that the pleat valleys that are open to water flow when the reversible baffle is orientated for sound reducing operation (e.g., the first valleys 472 discussed above) are narrower than the pleat valleys that are open to water flow when the reversible baffle is orientated for high water flow operation (e.g., the second valleys 474). Also in at least some embodiments, the pleat valleys that are open to water flow when the reversible baffle is orientated for sound reducing operation have narrower openings proximate the central orifice of the reversible baffle than do the pleat valleys that are open to water flow when the reversible baffle is orientated for high water flow operation.

Relatedly, in at least some embodiments, the pleats are configured so that the pleat portions forming the valleys that are open to water flow when the reversible baffle is orientated for sound reducing operation extend outward away from a mid-plane of the baffle farther than the pleat portions forming the valleys that are open to water flow when the baffle is orientated for high water flow operation extend outward from the mid-plane. Correspondingly, the pleat portions forming the valleys that are open to water flow when the reversible baffle is orientated for sound reducing operation have a steeper angle ramping downward toward the central orifice, so as to enhance water flow, than do the pleats forming the valleys that are open to water flow when the reversible baffle is orientated for high water flow operation. These pleat configurations are appropriate particularly insofar as the openings leading from the valleys to the central orifice are narrower for sound reducing operation than for high water flow operation, and consequently the deeper extent and steeper decline of the valleys for sound reducing operation provides a greater opportunity for sound reduction associated with rapid and significant water backup. That is, due to this pleat configuration, in terms of the relative extents of the pleats outward from the mid-plane and relative steepness of the pleats, water tends to flow more rapidly toward—but not into—the central orifice when the reversible baffle is in the sound reducing orientation and water tends to flow more easily (even if with less force) when the reversible baffle is in the sound reducing orientation. Further, due to this pleat configuration, the water flow holes are at a comparatively high location relative to the mid-plane of the reversible baffle when the baffle is in the sound reducing orientation, which also tends to slow water migration past the baffle, and at a comparatively low location relative to the mid-plane to foster water flow therethrough when the baffle is in the high water flow orientation.

Additionally, such features permitting such dual modes of operation also can involve the presence of different inner diameters of the rim of the reversible baffle on the different sides of the baffle, and a drafted central orifice at the center of the reversible baffle. With respect to the different inner diameters, the reversible baffle particularly is designed to have an inner diameter of the rim surrounding the pleats facing vertically upward, when the reversible baffle is in the sound reducing orientation, that is smaller than another inner diameter of the rim surrounding the pleats facing vertically upward when the reversible baffle is in the high water flow orientation. With such an arrangement, the sound reducing side of the reversible baffle has a smaller inner diameter that tends to further displace water, to increase the height of the water dam, and to help prevent sound from escaping the grind chamber. As for the drafted central orifice, which particularly can be formed by way of skewing the tips of the pleats around the central orifice, this entails drafting the central orifice so that it effectively constitutes a larger opening for water passage when the reversible baffle is in the high water flow orientation, but a smaller opening for water passage when the baffle is in the sound reducing orientation. Stated in another manner, the central orifice is drafted to create a larger opening at the bottom of the high water flow side of the reversible baffle, so as to improve flow, and a smaller, more restrictive hole at the bottom of the sound reducing side of the baffle. Although the drafting of the central orifice in at least some embodiments particularly entails the sloping of portions of the sidewalls (e.g., portions of the interior edges 1206) extending between adjacent pleat portions toward or away from the central axis so as to vary the extent to which the pleat tips of adjacent pleat portions extend toward the central axis, depending upon the embodiment the drafting of the central orifice can also entail sloping of the sidewall portions in directions extending around the central axis (e.g., in an angular or circumferential manner) so as to affect the sizes of the openings (e.g., the widths of the openings 900 or narrow width openings 800 described above) through which water will flow into the central orifice.

Although in accordance with some embodiments of reversible baffles encompassed herein, the reversible baffle can be implemented in either of two orientations to achieve an improved food waste disposer system that is configured either for sound reducing operation or high water flow operation, the present disclosure is also intended to encompass reversible baffles that achieve one or more additional functional objectives in addition to, or instead of, sound reducing operation or high water flow operation. For example, in at least some other embodiments, the reversible baffle can be implemented with pleats in which the pleat portions have vertical walls (or sidewall portions) that are of different thicknesses on different sides of each pleat (or each pleat portion). By virtue of such vertical walls, the pleats of the reversible baffle can avoid experiencing bi-stability, and particularly reduce the chances that any of the pleats will become caught in "over-center" positions or become stuck down during use.

Further, although some of the embodiments of reversible baffles encompassed herein entail asymmetric reversible baffles that can be implemented in either of two orientations within a baffle-less food waste disposer system, so as to achieve different functional objectives depending upon the orientation of the reversible baffle, the present disclosure is also intended to encompass reversible baffles that are symmetric or effectively symmetric (again, e.g., with respect to a mid-plane of the baffle). Such symmetric reversible baffles can allow for one or more additional functional objectives or advantages to be achieved. For example, in conventional rubber baffles, if the rubber pleats of the baffle begin to droop (or droop significantly), the baffle's ability to prevent water and food waste from splashing out of the disposer grind chamber during use is diminished. Yet symmetric reversible baffles encompassed by the present disclosure can, in at least some embodiments, achieve a functional objective of prolonging or lengthening the effective life of the baffle, by remedying, delaying, or avoiding sagging (or excessive sagging) of one or more of the pleats of the baffle.

More particularly, because the symmetric reversible baffles can be implemented within a baffle-less food waste disposer system in either of two orientations and provide effectively the same functionality regardless of orientation, use of the reversible baffle can prolong the effective useful life of the baffle insofar as, if the baffle is becoming a sagging baffle (with one or more sagging pleats) when in the one orientation, the user can flip over the baffle from the one orientation to the opposite orientation and still achieve substantially the same desired performance of the baffle. It should be appreciated that this benefit to users can be achieved without the asymmetric reversible baffle features suited for achieving sound reducing and high water flow operation as described above. Notwithstanding this being the case, an asymmetric reversible baffle can also achieve, at least to some extent, this functional objective or advantage of remedying, delaying, or avoiding sagging pleats. Also, it should be appreciated that the present disclosure is intended to encompass embodiments of symmetric reversible baffles having one or more features of the asymmetric reversible baffle that allow the symmetric reversible baffle to be configured to achieve sound reducing operation regardless of the orientation of the reversible baffle, or to achieve high water flow operation regardless of the orientation of the reversible baffle. For example, a reversible baffle having water flow holes on all of its pleat portions can be a baffle that achieves enhanced or high water flow operation.

It is specifically intended that the present invention not be limited to the embodiments and illustrations contained herein, but include modified forms of those embodiments including portions of the embodiments and combinations of elements of different embodiments as come within the scope of the following claims.

I claim:

1. A baffle for a disposer system, the baffle comprising:

a cylindrical rim that extends circumferentially about a central axis;

a plurality of pleats that are attached to, or integrally formed with, the cylindrical rim and that extend radially inwardly toward the central axis, wherein each of the pleats has a respective radially-innermost edge and the radially-innermost edges of the pleats collectively define, at least partly, a central orifice of the baffle through which the central axis passes;

wherein the pleats include first pleat portions, second pleat portions, and sidewall portions;

wherein each of the first pleat portions is connected by way of a respective pair of the sidewall portions with a respective pair of the second pleat portions;

wherein each of the second pleat portions is connected by way of a respective pair of the sidewall portions with a respective pair of the first pleat portions; and wherein each of the first pleat portions, alone or in combination with the respective pair of the sidewall portions between which the respective first pleat portion is positioned, has a first structural characteristic configured to achieve a first functional objective when the disposer system is operated with the baffle oriented in a first orientation within the disposer system;

wherein each of the second pleat portions, alone or in combination with the respective pair of the sidewall portions between which the respective second pleat portion is positioned, has a second structural characteristic configured to achieve a second functional objective when the disposer system is operated with the baffle oriented in a second orientation within the disposer system;

wherein the first and second structural characteristics both are of a same type but also are different from one another; and wherein the baffle includes an annular groove formed in an outer cylindrical surface of the cylindrical rim that extends circumferentially around the cylindrical rim and that is centered midway between a first annular edge and a second annular edge, and wherein the annular groove is configured to receive a complementary or substantially complementary formation of a sink flange into which the baffle is configured to be positioned, both when the baffle is implemented in the first orientation and when the baffle is implemented in the second orientation, whereby due at least in part to the first and second structural characteristics being different from one another, the baffle is capable of being implemented within the disposer system in either of the first and second orientations to achieve either of the first and second functional objectives when the disposer system is operated.

2. The baffle of claim 1, wherein the first structural characteristic is a first angular extent of each of the first pleat portions about the central axis, wherein the second structural characteristic is a second angular extent of each of the second pleat portions about the central axis, and wherein the first angular extent is greater than the second angular extent.

3. The baffle of claim 1, wherein the radially-innermost edges of the pleats define a plurality of first openings and a plurality of second openings, wherein the respective first openings are formed at least in part by the respective first pleat portions and the respective pairs of the sidewall portions by way of which the respective first pleat portions are connected with the respective pairs of the second pleat portions;

wherein the respective second openings are formed at least in part by the respective second pleat portions and the respective pairs of the sidewall portions by way of which the respective second pleat portions are connected with the respective pairs of the first pleat portions;

wherein the first structural characteristic is a first width of each of the first openings and the second structural characteristic is a second width of each of the second openings; and wherein the first width is greater than the second width.

4. The baffle of claim 1, wherein the first structural characteristic is a presence of a respective flow hole through each of the first pleat portions, and wherein the second structural characteristic is an absence of any flow hole from each of the second pleat portions.

5. The baffle of claim 1, wherein the first structural characteristic is a first maximum axial extent of each of the first pleat portions away from a mid-plane of the baffle extending perpendicularly or substantially perpendicularly relative to the central axis, and wherein the second structural characteristic is a second maximum axial extent of each of the second pleat portions away from the mid-plane, and wherein the second maximum axial extent is greater than the first maximum axial extent.

6. The baffle of claim 5, wherein each of the first pleat portions extends axially outwardly away from the mid-plane as the respective first pleat portion extends radially inwardly from the cylindrical rim toward the central axis up to a respective first tip of the respective first pleat portion, substantially along a first angle relative to the mid-plane, and wherein each of the second pleat portions extends axially outwardly away from the mid-plane as the respective second pleat portion extends radially inwardly from the cylindrical rim toward the central axis up to a respective second tip of the respective second pleat portion, substantially along a second angle relative to the mid-plane, and wherein the second angle is greater than the first angle.

7. The baffle of claim 5, wherein each of the first pleat portions includes a respective flow hole, and wherein the flow holes are positioned on the first pleat portions at locations that are axially shifted in directions parallel to the central axis away from the mid-plane, so that the locations are all vertically above the mid-plane when the baffle is implemented in the first orientation and all vertically below the mid-plane when the baffle is implemented in the second orientation.

8. The baffle of claim 1, wherein each of the first pleat portions extends radially inwardly from the cylindrical rim toward the central axis up to a respective first tip of the respective first pleat portion, and each of the second pleat portions extends radially inwardly from the cylindrical rim toward the central axis up to a respective second tip of the respective second pleat portion, wherein the first structural characteristic is a first radial distance of each of the first tips from the central axis and the second structural characteristic is a second radial distance of each of the second tips from the central axis, and wherein the first radial distance is greater than the second radial distance.

9. The baffle of claim 8, wherein the central orifice is a drafted central orifice having a first effective size determined at least in part by the first radial distance that is greater than a second effective size determined at least in part by the second radial distance.

10. The baffle of claim 8, wherein a respective first one of the sidewall portions of each of the respective pairs of the sidewall portions by way of which the respective first pleat portions are connected with the respective pairs of the second pleat portions has a first thickness, and a respective second one of the sidewall portions of each of the respective pairs of the sidewall portions by way of which the respective first pleat portions are connected with the respective pairs of the second pleat portions has a second thickness, and wherein the first thickness is greater than the second thickness and consequently a further functional objective of avoiding pleat bi-stability is at least partly achieved.

11. The baffle of claim 1, wherein the first structural characteristic is a first outer diameter of the first pleat portions defined by a first inner diameter of the cylindrical rim, and wherein the second structural characteristic is a second outer diameter of the second pleat portions defined by a second inner diameter of the cylindrical rim, and wherein the second outer diameter is greater than the first outer diameter.

12. The baffle of claim 1, wherein the baffle is made of nitrile rubber, wherein the pleats are formed integrally with the cylindrical rim, and wherein the plurality of pleats includes either four of the pleats or three of the pleats.

13. A method of implementing the baffle of claim 1 in relation to a sink flange of the disposer system, the method comprising:

making a determination regarding whether the disposer system should be configured to operate in accordance with a first operational mode to achieve the first functional objective, or in accordance with a second operational mode to achieve the second functional objective;

inserting the baffle into a sink flange of the disposer system; and receiving a protrusion extending radially-inwardly from an inner surface of the sink flange into the annular groove so that the baffle is supported in relation to the sink flange, and wherein the baffle is inserted into and supported in relation to the sink flange so that the baffle has the first orientation or so that the baffle has the second orientation in accordance with the determination.

14. A method of operating the baffle after being implemented in accordance with the method of claim 13, the method comprising:

receiving water or other material atop a vertically upward-facing or substantially vertically upward-facing face of the baffle;

communicating the water or other material within valleys formed with the face; and passing the water or other material to a location beneath the baffle by way of the central orifice or one or more flow holes of the baffle.

15. A baffle for a disposer system, the baffle comprising:

a cylindrical rim that extends circumferentially about a central axis;

a plurality of pleats that are attached to, or integrally formed with, the cylindrical rim and that extend radially inwardly toward the central axis, wherein each of the pleats has a respective radially-innermost edge and the radially-innermost edges of the pleats collectively define, at least partly, a central orifice of the baffle through which the central axis passes, and wherein the pleats include first pleat portions and second pleat portions;

wherein a first face of the baffle is formed at least in part by way of first surface portions of the first pleat portions, second surface portions of the second pleat portions, and a first annular edge of the cylindrical rim, and a second face of the baffle is formed at least in part by way of third surface portions of the first pleat portions, fourth surface portions of the second pleat portions, and a second annular edge of the cylindrical rim;

wherein the first face and second face are substantially oppositely directed relative to one another, on opposite sides of a mid-plane of the baffle that extends perpendicularly or substantially perpendicularly relative to the central axis;

wherein the first face includes a first structural characteristic configured to achieve a first functional objective when the disposer system is operated with the baffle oriented in a first orientation within the disposer system, and the second face includes a second structural characteristic configured to achieve a second functional objective when the disposer system is operated with the baffle oriented in a second orientation within the disposer system, and wherein the first and second structural characteristics are of a same type but also are different; and wherein the baffle includes an annular groove formed in an outer cylindrical surface of the cylindrical rim that extends circumferentially around the cylindrical rim and that is centered midway between a first annular edge and a second annular edge, and wherein the annular groove is configured to receive a complementary or substantially complementary formation of a sink flange into which the baffle is configured to be positioned, both when the baffle is implemented in the first orientation and when the baffle is implemented in the second orientation, whereby due at least in part to the first and second structural characteristics being different from one another, the baffle is capable of being implemented within the disposer system in either of the first and second orientations to achieve either of the first and second functional objectives when the disposer system is operated.

16. The baffle of claim 15, wherein the first face includes a plurality of first valleys formed at least in part by the second surface portions, wherein the second face includes a plurality of second valleys formed at least in part by the third surface portions, and wherein the second valleys are configured to more easily convey water therethrough than the first valleys due at least in part to the first structural characteristic and second structural characteristic being different from one another.

17. The baffle of claim 16, wherein the first structural characteristic includes one or more of a first angular extent of each of the first valleys, a first width of each of a plurality of first openings of the respective first valleys into the central orifice, a first depth of each of the first valleys relative to the mid-plane of the baffle, and a first radial distance between each of the respective first valleys and the central axis; and wherein the second structural characteristic includes one or more of a second angular extent of each of the second valleys, a second width of each of a plurality of second openings of the respective second valleys into the central orifice, a second depth of each of the second valleys relative to the mid-plane of the baffle, and a second radial distance between each of the respective second valleys and the central axis.

18. The baffle of claim 17, wherein flow holes are provided within the second valleys along respective lengths thereof, and wherein a first outer diameter of the first pleat portions is smaller than a second outer diameter of the second pleat portions.

19. The baffle of claim 16, wherein each of the first valleys has a respective pair of sidewall surfaces that are substantially parallel with a respective axis passing through the respective first valley, radially-outwardly from the central axis to the cylindrical rim; or wherein the cylindrical rim extends axially between first and second annular edges that that are positioned axially outwardly from one or more locations at which the pleats are attached to the cylindrical rim.

20. A disposer system comprising:

a disposer; and a mounting assembly coupled to the disposer, wherein the mounting assembly includes a sink flange and a baffle supported within the sink flange;

wherein the baffle includes a cylindrical rim extending about a central axis and a plurality of pleats having first pleat portions and second pleat portions extending radially inwardly from locations at or near the cylindrical rim toward the central axis, and also includes a mid-plane extending perpendicularly to the central axis;

wherein the baffle is positioned in a first orientation relative to the sink flange but is configured so that the baffle can be repositioned within the sink flange in a second orientation that is inverted relative to the first orientation;

wherein the pleats include a first structural characteristic that enables the disposer system to operate in accordance with a first operational mode when the baffle is positioned in the first orientation, and also include a second structural characteristic that would enable the disposer system to be configured to operate in accordance with a second operational mode if the baffle was positioned in the second orientation, wherein the first and second structural characteristics both are of a same type but also are different from one another; and wherein the first structural characteristic is selected from the group consisting of a first angular extent of the first pleat portions of the pleats, a first width of first openings proximate first tips of the first pleat portions, a first axial extent of the first tips of the first pleat portions relative to the mid-plane of the baffle, a first outer diameter of the first pleat portions, a first radial distance between the central axis and the first tips of the first pleat portions, and a first presence or absence of first flow holes extending through the first pleat portions;

wherein the second structural characteristic is selected from the group consisting of a second angular extent of the second pleat portions of the pleats, a second width of second openings proximate second tips of the second pleat portions, a second axial extent of the second tips of the second pleat portions relative to the mid-plane of the baffle, a second outer diameter of the second pleat portions, a second radial distance between the central axis and the second tips of the second pleat portions, and a second presence or absence of second flow holes extending through the second pleat portions; and wherein the baffle includes an annular groove formed in an outer cylindrical surface of the cylindrical rim that extends circumferentially around the cylindrical rim and that is centered midway between a first annular edge and a second annular edge, and wherein the annular groove is configured to receive a complementary or substantially complementary formation of a sink flange into which the baffle is configured to be positioned, both when the baffle is implemented in the first orientation and when the baffle is implemented in the second orientation.

* * * * *